US012385369B2

(12) United States Patent
Eitschberger et al.

(10) Patent No.: US 12,385,369 B2
(45) Date of Patent: Aug. 12, 2025

(54) PERFORATING GUN ASSEMBLY WITH ROTATING SHAPED CHARGE HOLDER

(71) Applicant: DynaEnergetics Europe GmbH, Troisdorf (DE)

(72) Inventors: Christian Eitschberger, Munich (DE); Gernot Uwe Burmeister, Austin, TX (US); Arash Shahinpour, Troisdorf (DE)

(73) Assignee: DynaEngergetics Europe GmbH, Troisdorf (DE)

( * ) Notice: Subject to any disclaimer, the term of this patent is extended or adjusted under 35 U.S.C. 154(b) by 172 days.

(21) Appl. No.: 17/610,377

(22) PCT Filed: Jun. 12, 2020

(86) PCT No.: PCT/EP2020/066327
§ 371 (c)(1),
(2) Date: Nov. 10, 2021

(87) PCT Pub. No.: WO2020/249744
PCT Pub. Date: Dec. 17, 2020

(65) Prior Publication Data

US 2022/0268135 A1 Aug. 25, 2022

Related U.S. Application Data

(60) Provisional application No. 62/928,462, filed on Oct. 31, 2019, provisional application No. 62/861,601, filed on Jun. 14, 2019.

(51) Int. Cl.
*E21B 43/119* (2006.01)
*E21B 43/1185* (2006.01)

(52) U.S. Cl.
CPC ..... *E21B 43/119* (2013.01); *E21B 43/1185* (2013.01)

(58) Field of Classification Search
CPC .. E21B 43/117; E21B 43/118; E21B 43/1185; E21B 43/119
See application file for complete search history.

(56) References Cited

U.S. PATENT DOCUMENTS 2,147,544 A 2/1939 Potts
2,216,359 A 10/1940 Spencer
(Continued)

FOREIGN PATENT DOCUMENTS

AU 2010217183 B2 6/2016
CA 288787 A 4/1929
(Continued)

OTHER PUBLICATIONS

Norwegian Industrial Property Office; Office Action and Search Report for NO App. No. 20171759; Jan. 14, 2020; 6 pages.
(Continued)

*Primary Examiner* — Robert E Fuller
(74) *Attorney, Agent, or Firm* — Womble Bond Dickinson (US) LLP

(57) ABSTRACT

A shaped charge positioning device may include a shaped charge holder, an initiator holder coupled to the shaped charge holder via a first rotation coupling, and a shaped charge receptacle provided on the shaped charge holder. The shaped charge receptacle may be rotatable around a central longitudinal axis of rotation of the shaped charge positioning device relative to the initiator holder. A perforating gun assembly may include a shaped charge holder provided in a gun housing chamber and rotatable relative to the gun housing. A wellbore tool string may include a first gun housing including a first shaped charge holder rotatably coupled to a second gun housing including a second shaped
(Continued)

charge holder. An initiator provided in the first gun housing may be electrically coupled to an initiator provided in the second gun housing.

12 Claims, 18 Drawing Sheets

(56) References Cited

U.S. PATENT DOCUMENTS 2,358,466 A 9/1944 Miller
2,418,486 A 4/1947 Smylie
2,598,651 A 5/1952 Spencer
2,742,857 A 4/1956 Turechek
2,889,775 A 6/1959 Owen
2,923,204 A 2/1960 Mohaupt
3,002,559 A 10/1961 Dean
3,071,072 A 1/1963 Castel et al.
3,170,400 A 2/1965 Nelson
3,246,707 A 4/1966 Bell
3,264,986 A 8/1966 Mohaupt
3,336,054 A 8/1967 Blount et al.
3,374,735 A 3/1968 Moore
3,426,849 A 2/1969 Brumble, Jr.
3,426,850 A 2/1969 Mcduffie, Jr.
3,504,723 A 4/1970 Cushman et al.
3,859,921 A 1/1975 Stephenson
3,923,105 A 12/1975 Lands
4,007,790 A 2/1977 Henning
4,007,796 A 2/1977 Boop
4,058,061 A 11/1977 Mansur, Jr. et al.
4,140,188 A 2/1979 Vann
4,182,216 A 1/1980 DeCaro
4,193,460 A 3/1980 Gilbert
4,266,613 A 5/1981 Boop
4,290,486 A 9/1981 Regalbuto
4,291,623 A * 9/1981 Robinson ..... E21B 43/1185 86/22
4,491,185 A 1/1985 McClure
4,496,008 A 1/1985 Pottier et al.
4,523,649 A 6/1985 Stout
4,523,650 A 6/1985 Sehnert et al.
4,574,892 A 3/1986 Grigar et al.
4,583,602 A 4/1986 Ayers
4,598,775 A 7/1986 Vann et al.
4,621,396 A 11/1986 Walker et al.
4,629,001 A 12/1986 Miller et al.
4,637,478 A 1/1987 George
4,650,009 A 3/1987 McClure et al.
4,655,138 A 4/1987 Regalbuto et al.
4,657,089 A 4/1987 Stout
4,672,896 A 6/1987 Precoul et al.
4,747,201 A 5/1988 Donovan et al.
4,753,170 A 6/1988 Regalbuto et al.
4,776,393 A 10/1988 Forehand et al.
4,790,383 A 12/1988 Savage et al.
4,800,815 A 1/1989 Appledorn et al.
4,830,120 A 5/1989 Stout
4,889,183 A 12/1989 Sommers et al.
5,027,708 A 7/1991 Gonzalez et al.
5,033,553 A 7/1991 Miszewski et al.
5,040,619 A 8/1991 Jordan et al.
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,211,714 A 5/1993 Jordan et al.
5,322,019 A 6/1994 Hyland
5,385,098 A 1/1995 Lindqvist et al.
5,392,860 A 2/1995 Ross
5,436,791 A 7/1995 Turano et al.
5,531,164 A 7/1996 Mosley
5,603,384 A 2/1997 Bethel et al.
D378,847 S 4/1997 Ey
5,703,319 A 12/1997 Fritz et al.
5,775,426 A 7/1998 Snider et al.
5,778,979 A 7/1998 Burleson et al.
5,816,343 A 10/1998 Markel et al.
5,823,266 A 10/1998 Burleson et al.
5,964,294 A 10/1999 Edwards et al.
5,992,289 A 11/1999 George et al.
6,006,833 A 12/1999 Burleson et al.
6,012,525 A 1/2000 Burleson et al.
6,070,662 A 6/2000 Ciglenec et al.
6,112,666 A 9/2000 Murray et al.
6,298,915 B1 10/2001 George
6,305,287 B1 10/2001 Capers et al.
6,354,374 B1 3/2002 Edwards et al.
6,418,853 B1 7/2002 Duguet et al.
6,516,901 B1 2/2003 Falgout
6,591,911 B1 7/2003 Markel et al.
6,595,290 B2 7/2003 George et al.
6,651,747 B2 11/2003 Chen et al.
6,679,327 B2 1/2004 Sloan et al.
6,739,265 B1 5/2004 Badger et al.
6,742,602 B2 6/2004 Trotechaud
6,752,083 B1 6/2004 Lerche et al.
6,837,310 B2 1/2005 Martin
6,843,317 B2 1/2005 Mackenzie
6,843,318 B2 1/2005 Yarbro
6,851,476 B2 2/2005 Gray et al.
6,902,414 B2 6/2005 Dopf et al.
6,942,033 B2 9/2005 Brooks et al.
7,000,699 B2 2/2006 Yang et al.
7,107,908 B2 9/2006 Forman et al.
7,114,564 B2 10/2006 Parrott et al.
7,193,527 B2 3/2007 Hall
7,237,486 B2 7/2007 Myers, Jr. et al.
7,278,491 B2 10/2007 Scott
7,364,451 B2 4/2008 Ring et al.
7,568,429 B2 8/2009 Hummel et al.
7,762,172 B2 7/2010 Li et al.
7,778,006 B2 8/2010 Stewart et al.
7,810,430 B2 10/2010 Chan et al.
7,886,842 B2 2/2011 Howard et al.
7,901,247 B2 3/2011 Ring
7,908,970 B1 3/2011 Jakaboski et al.
7,929,270 B2 4/2011 Hummel et al.
D637,492 S 5/2011 Baird et al.
D642,060 S 7/2011 Leclair et al.
8,061,425 B2 11/2011 Hales et al.
8,066,083 B2 11/2011 Hales et al.
8,069,789 B2 12/2011 Hummel et al.
8,127,848 B2 3/2012 Myers, Jr. et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,256,337 B2 9/2012 Hill
8,395,878 B2 3/2013 Stewart et al.
8,439,114 B2 5/2013 Parrott et al.
8,443,886 B2 5/2013 Torres et al.
8,451,137 B2 5/2013 Bonavides et al.
8,596,378 B2 12/2013 Mason et al.
8,661,978 B2 3/2014 Backhus et al.
8,684,083 B2 4/2014 Torres et al.
8,695,506 B2 4/2014 Lanclos
8,810,247 B2 8/2014 Kuckes
8,863,665 B2 10/2014 DeVries et al.
8,875,787 B2 11/2014 Tassaroli
8,875,796 B2 11/2014 Hales et al.
8,881,816 B2 11/2014 Glenn et al.
9,038,521 B1 5/2015 Rollins et al.
9,080,433 B2 7/2015 Lanclos et al.
9,115,572 B1 8/2015 Hardesty et al.
9,145,764 B2 9/2015 Burton et al.
9,181,790 B2 11/2015 Mace et al.
9,194,219 B1 11/2015 Hardesty et al.
9,284,819 B2 3/2016 Tolman et al.
9,297,242 B2 3/2016 Zhang et al.
9,382,784 B1 7/2016 Hardesty et al.
9,441,438 B2 9/2016 Allison et al.

(56) References Cited

U.S. PATENT DOCUMENTS 9,476,289 B2 10/2016 Wells
9,494,021 B2 11/2016 Parks et al.
9,523,265 B2 12/2016 Upchurch et al.
9,562,421 B2 2/2017 Hardesty et al.
9,581,422 B2 2/2017 Preiss et al.
9,598,942 B2 3/2017 Wells et al.
9,605,937 B2 3/2017 Eitschberger et al.
9,677,363 B2 6/2017 Schacherer et al.
9,689,223 B2 6/2017 Schacherer et al.
9,702,680 B2 7/2017 Parks et al.
9,784,549 B2 10/2017 Eitschberger
9,845,666 B2 12/2017 Hardesty et al.
9,903,185 B2 2/2018 Ursi et al.
9,903,192 B2 2/2018 Entchev et al.
10,060,234 B2 8/2018 Robey et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,429,161 B2 10/2019 Parks et al.
10,458,213 B1 10/2019 Eitschberger et al.
10,472,901 B2 11/2019 Engel et al.
10,594,102 B2 3/2020 Pratt et al.
10,597,987 B2 3/2020 Escudero et al.
10,683,703 B2 6/2020 Faircloth et al.
10,689,955 B1 6/2020 Mauldin et al.
D900,036 S 10/2020 Wuester et al.
10,844,696 B2 11/2020 Fitschberger et al.
10,845,178 B2 11/2020 Eitschberger et al.
10,900,334 B2 1/2021 Knight et al.
10,900,335 B2 1/2021 Knight et al.
10,920,543 B2 2/2021 Eitschberger
10,954,761 B2 3/2021 Kaenel et al.
10,982,941 B2 4/2021 Eitschberger
11,053,783 B2 7/2021 Ashton et al.
11,078,762 B2 8/2021 Mauldin et al.
11,125,056 B2 9/2021 Parks et al.
11,168,546 B2 11/2021 Melhus et al.
11,215,041 B2 1/2022 Knight et al.
11,391,127 B1 7/2022 Hoelscher et al.
11,542,792 B2 1/2023 Preiss
11,834,934 B2 12/2023 Prisbell et al.
11,867,032 B1 1/2024 Parks et al.
11,959,367 B2 4/2024 Bradley et al.
12,098,623 B2 9/2024 Lowe et al.
12,221,864 B1 2/2025 Mauldin et al.
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2005/0139352 A1 6/2005 Mauldin
2005/0167101 A1 8/2005 Sugiyama
2005/0178282 A1 8/2005 Brooks et al.
2005/0186823 A1 8/2005 Ring et al.
2005/0194146 A1 9/2005 Barker et al.
2005/0229805 A1 10/2005 Myers, Jr. et al.
2005/0230099 A1 10/2005 Thomson et al.
2006/0075889 A1 4/2006 Walker
2007/0084336 A1 4/2007 Neves
2007/0119327 A1 5/2007 Myers et al.
2007/0125540 A1 6/2007 Gerez et al.
2007/0158071 A1 7/2007 Mooney et al.
2007/0227635 A1 10/2007 Marlin et al.
2008/0047456 A1 2/2008 Li et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2009/0050322 A1 2/2009 Hill et al.
2009/0151588 A1 6/2009 Burleson et al.
2009/0272529 A1 11/2009 Crawford
2010/0000789 A1 1/2010 Barton et al.
2010/0011945 A1 1/2010 Loehr
2010/0089643 A1 4/2010 Vidal
2010/0163224 A1 7/2010 Strickland
2010/0230104 A1 9/2010 Nölke et al.
2010/0230163 A1 9/2010 Hales et al.
2010/0300750 A1 12/2010 Hales et al.
2011/0024116 A1 2/2011 McCann et al.
2011/0100627 A1 5/2011 Hales et al.
2012/0085538 A1 4/2012 Guerrero et al.
2012/0199031 A1 8/2012 Lanclos
2012/0199352 A1 8/2012 Lanclos et al.
2012/0227962 A1 9/2012 Richard
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0062055 A1 3/2013 Tolman et al.
2013/0098257 A1 4/2013 Goodridge et al.
2013/0118342 A1 5/2013 Tassaroli
2013/0199843 A1 8/2013 Ross
2013/0220614 A1 8/2013 Torres et al.
2013/0248174 A1 9/2013 Dale et al.
2014/0008071 A1 1/2014 Patterson et al.
2014/0131035 A1 5/2014 Entchev et al.
2015/0075783 A1 3/2015 Angman et al.
2015/0176386 A1 6/2015 Castillo et al.
2015/0226043 A1 8/2015 Hardesty et al.
2015/0226044 A1 8/2015 Ursi et al.
2015/0330192 A1 11/2015 Rogman et al.
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0168961 A1 6/2016 Parks et al.
2016/0208587 A1 7/2016 Hardesty et al.
2016/0273902 A1 9/2016 Eitschberger
2016/0290084 A1 10/2016 LaGrange et al.
2016/0356132 A1 12/2016 Burmeister et al.
2016/0365667 A1 12/2016 Mueller et al.
2017/0030693 A1 2/2017 Preiss et al.
2017/0052011 A1 2/2017 Parks et al.
2017/0145798 A1 5/2017 Robey et al.
2017/0211363 A1 7/2017 Bradley et al.
2017/0241244 A1 8/2017 Barker et al.
2017/0268317 A1 9/2017 Kaenel et al.
2017/0268860 A1 9/2017 Eitschberger
2017/0314372 A1 11/2017 Tolman et al.
2018/0030334 A1 2/2018 Collier et al.
2018/0135398 A1 5/2018 Entchev et al.
2018/0202789 A1 7/2018 Parks et al.
2018/0209251 A1 7/2018 Robey et al.
2018/0216446 A1 8/2018 Allison
2018/0252054 A1 9/2018 Stokes
2018/0274342 A1 9/2018 Sites
2018/0299239 A1 10/2018 Eitschberger et al.
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0162055 A1 5/2019 Collins et al.
2019/0186241 A1 6/2019 Yang et al.
2019/0195054 A1 6/2019 Bradley et al.
2019/0211655 A1 7/2019 Bradley et al.
2019/0257158 A1 8/2019 Langford et al.
2019/0264548 A1 8/2019 Zhao et al.
2019/0284889 A1 9/2019 LaGrange et al.
2019/0292887 A1 9/2019 Austin, II et al.
2019/0316449 A1 10/2019 Schultz et al.
2020/0024934 A1 1/2020 Eitschberger et al.
2020/0024935 A1 1/2020 Eitschberger et al.
2020/0072029 A1 3/2020 Anthony et al.
2020/0157924 A1 5/2020 Melhus et al.
2020/0256167 A1 8/2020 Gupta et al.
2020/0284126 A1 9/2020 Mauldin et al.
2020/0332630 A1 10/2020 Davis et al.

(56) References Cited

U.S. PATENT DOCUMENTS

| | | | |
|---|---|---|---|
| 2021/0172298 | A1 | 6/2021 | Knight et al. |
| 2021/0238966 | A1 | 8/2021 | Preiss et al. |
| 2021/0277753 | A1 | 9/2021 | Ursi et al. |
| 2021/0317728 | A1 | 10/2021 | Preiss et al. |
| 2021/0340844 | A1 | 11/2021 | Fitschberger et al. |
| 2021/0348485 | A1 | 11/2021 | Mauldin et al. |
| 2022/0074289 | A1 | 3/2022 | Cardenas et al. |
| 2022/0258103 | A1 | 8/2022 | Eitschberger et al. |
| 2022/0307330 | A1 | 9/2022 | Eitschberger et al. |
| 2022/0372851 | A1 | 11/2022 | Preiss et al. |
| 2024/0003200 | A1 | 1/2024 | Knight et al. |
| 2024/0183252 | A1 | 6/2024 | Sullivan et al. |

FOREIGN PATENT DOCUMENTS

| | | | | |
|---|---|---|---|---|
| CA | 2821506 | A1 | | 1/2015 |
| CA | 2941648 | A1 | | 9/2015 |
| CA | 2888787 | A1 | | 10/2015 |
| CA | 2821506 | C | | 3/2020 |
| CN | 85107897 | A | | 9/1986 |
| CN | 2698970 | Y | | 5/2005 |
| CN | 101300403 | A | | 11/2008 |
| CN | 101397890 | A | | 4/2009 |
| CN | 101454635 | A | | 6/2009 |
| CN | 201620848 | U | | 11/2010 |
| CN | 102155202 | A | | 8/2011 |
| CN | 104278976 | A | | 1/2015 |
| CN | 204200197 | U | | 3/2015 |
| CN | 104989335 | A | * | 10/2015 |
| CN | 105392961 | A | | 3/2016 |
| CN | 205805521 | U | | 12/2016 |
| CN | 104314529 | B | | 1/2017 |
| CN | 205895214 | U | | 1/2017 |
| CN | 107100597 | A | | 8/2017 |
| CN | 208280947 | U | | 12/2018 |
| CN | 209195375 | U | | 8/2019 |
| CN | 211287646 | U | | 8/2020 |
| CN | 112424443 | A | | 2/2021 |
| CN | 212837726 | U | | 3/2021 |
| CN | 112840101 | A | | 5/2021 |
| CN | 214836284 | U | | 11/2021 |
| EP | 1473437 | A2 | | 11/2004 |
| EP | 3245380 | B1 | | 4/2020 |
| GB | 2395970 | A | | 6/2004 |
| GB | 2531450 | B | | 2/2017 |
| GB | 2548203 | A | | 9/2017 |
| RU | 78521 | U1 | | 11/2008 |
| RU | 2579307 | C1 | | 4/2016 |
| RU | 2633904 | C1 | | 10/2017 |
| WO | 8802056 | A1 | | 3/1988 |
| WO | 1988002056 | A1 | | 3/1988 |
| WO | 9905390 | A1 | | 2/1999 |
| WO | 1999005390 | A1 | | 2/1999 |
| WO | 0159401 | A1 | | 8/2001 |
| WO | 2001059401 | A1 | | 8/2001 |
| WO | 2008067771 | A1 | | 6/2008 |
| WO | 2008098047 | A2 | | 8/2008 |
| WO | 2008098052 | A3 | | 10/2008 |
| WO | 2009091422 | A2 | | 7/2009 |
| WO | 2009142957 | A1 | | 11/2009 |
| WO | 2010104634 | A2 | | 9/2010 |
| WO | 2010104634 | A3 | | 11/2010 |
| WO | 2012006357 | A2 | | 1/2012 |
| WO | 2014179689 | A1 | | 11/2014 |
| WO | 2015006869 | A1 | | 1/2015 |
| WO | 2015134719 | A1 | | 9/2015 |
| WO | 2015173592 | A1 | | 11/2015 |
| WO | 2016037122 | A1 | | 3/2016 |
| WO | 2018009223 | A1 | | 1/2018 |
| WO | 2018026952 | A1 | | 2/2018 |
| WO | WO-2018067598 | A1 | * | 4/2018 ..... E21B 23/08 |
| WO | 2018125180 | A1 | | 7/2018 |
| WO | 2019009735 | A1 | | 1/2019 |
| WO | 2019148009 | A2 | | 8/2019 |
| WO | 2020016644 | A1 | | 1/2020 |
| WO | 2020112983 | A1 | | 6/2020 |
| WO | 2020232242 | A1 | | 11/2020 |
| WO | 2020249744 | A2 | | 12/2020 |
| WO | 2021025716 | A1 | | 2/2021 |
| WO | 2021116338 | A1 | | 6/2021 |
| WO | 2021185749 | A1 | | 9/2021 |
| WO | 2022184654 | A1 | | 9/2022 |
| WO | 2022184731 | A1 | | 9/2022 |

OTHER PUBLICATIONS

Norwegian Industrial Property Office; Office Action for NO Appl. No. 20160017; mailed Dec. 4, 2017; 2 pages.

Norwegian Industrial Property Office; Office Action for NO Appl. No. 20171759; mailed Oct. 30, 2020; pages.

Norwegian Industrial Property Office; Office Action for NO Appl. No. 20210799; dated Oct. 30, 2021; 2 pages.

Norwegian Industrial Property Office; Opinion for NO Appl. No. 20171759; mailed Apr. 5, 2019; 1 page.

Parrot, Robert; Declaration, PGR 2020-00080; dated Aug. 11, 2020; 400 pages.

Parrott, Robert et al.; U.S. Appl. No. 60/286,907; dated Apr. 27, 2001; 24 pages.

Parrott, Robert et al.; U.S. Appl. No. 60/306,938; dated Jul. 20, 2001; 26 pages.

Parrott, Robert; U.S. Appl. No. 60/307,086; dated Jul. 20, 2001; 15 pages.

Parrott, Robert; U.S. Appl. No. 60/307,087; filed Jul. 20, 2001; 16 pages.

Parrott, Robert; U.S. Appl. No. 60/310,970; dated Aug. 8, 2001; 15 pages.

Promperforator LLC, Perforating Systems Design and Manufacturing, 2014, 36 pgs., http://www.promperforator.ru/upload/file/katalog_eng_2014.pdf.

Ratanasirigulchai, Wanchai; U.S. Appl. No. 60/351,252; dated Jan. 23, 2002; 11 pages.

Schlumberger, OrientXact, 2013 2 pgs., https://www.slb.com/-/media/files/pe/product-sheet/orientxact-ps.ashx.

Schlumberger, Perforating Services Catalog, 2008, 521 pages.

Schlumberger; Fractal Flex Multistage stimulation perforating system; dated 2018; 1 page.

Shahinpour, New Perforating Design Offers 360-Degree Coverage, Dynaenergetics, Apr. 2, 2018, 5 pgs., https://www.hartenergy.com/ep/exclusives/new-perforating-design-offers-360-degree-coverage-176955.

State Intellectual Property Office People's Republic of China; First Office Action for Chinese App. No. 201811156092.7; issued Jun. 16, 2020; 6 pages (Eng Translation 8 pages).

State Intellectual Property Office, P.R. China; First Office Action for CN App. No. 201480047092.7; issued on Apr. 24, 2017.

State Intellectual Property Office, P.R. China; First Office Action with full translation for CN App. No. 201480040456.9; issued Mar. 29, 2017; 12 pages (English translation 17 pages).

State Intellectual Property Office, P.R. China; Notification to Grant Patent Right for CN App. No. 201480040456.9; Jun. 12, 2018; 2 pages (English translation 2 pages).

State Intellectual Property Office, P.R. China; Second Office Action for CN App. No. 201480040456.9; issued Nov. 29, 2017; 5 pages (English translation 1 page).

State Intellectual Property Office, P.R. China; Second Office Action for CN App. No. 201480047092.7; Issued Jan. 4, 2018; 3 pages.

SWM International, LLC and Nextier Completion Solutions Inc; Petitioner's Reply to Patent Owner's Response to Petition for Case No. PGR2021-00097; dated Jul. 29, 2022; 36 pages.

SWM International, LLC; Exhibit B: DynaEnergetics' Infringement of U.S. Pat. No. 11,078,762 for Civil Action No. 6:21-cv-00804; dated Aug. 3, 2021; 22 pages.

SWM International, LLC; SWM International, LLC's Responsive Claim Construction Brief for Civil Action No. 6:21-cv-804-ADA; dated Apr. 11, 2022; 21 pages.

(56) References Cited

OTHER PUBLICATIONS

Thru-Tubing Systems, Thru-Tubing Systems Wireline Products Catalog, Apr. 25, 2016, 45 pgs., http://www.thrutubingsystems.com/phire-content/assets/files/Thru%20Tubing%20Systems%20Wireline%20Products.pdf.
United States Patent and Trademark Office, Final Office Action of U.S. Appl. No. 16/359,540, dated Aug. 14, 2019, 9 pages.
United States Patent and Trademark Office, U.S. Pat. No. 10,472,938; 485 pages.
United States Patent and Trademark Office, Non-Final Office Action for U.S. Appl. No. 16/293,508, dated Mar. 15, 2021, 7 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/272,326, dated May 24, 2019, 17 pages.
United States Patent and Trademark Office, Non-Final Office Action of U.S. Appl. No. 16/359,540, dated May 3, 2019, 11 pages.
United States Patent and Trademark Office, Non-Final Office Action of U.S. Appl. No. 16/455,816, dated Jan. 13, 2020, 14 pages.
United States Patent and Trademark Office, Non-Final Office Action of U.S. Appl. No. 16/455,816, dated Jul. 2, 2020, 15 pages.
United States Patent and Trademark Office, Non-Final Office Action of U.S. Appl. No. 16/455,816, dated Nov. 5, 2019, 17 pages.
United States Patent and Trademark Office, Notice of Allowance for U.S. Appl. No. 15/920,800, dated Jul. 7, 2020, 7 pages.
United States Patent and Trademark Office, Notice of Allowance for U.S. Appl. No. 16/585,790, dated Jun. 19, 2020, 16 pages.
United States Patent and Trademark Office, Notice of Allowance of U.S. Appl. No. 16/272,326, dated Sep. 4, 2019. 9 pages.
United States Patent and Trademark Office, Office Action of U.S. Appl. No. 16/511,495, dated Aug. 27, 2020, 20 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Appl. No. 61/733,129; filed Dec. 4, 2012; 10 pages.
United States Patent and Trademark Office, U.S. Appl. No. 61/819,196; filed May 3, 2013 ; 10 pages.
United States Patent and Trademark Office; Final Office Action of U.S. Appl. No. 16/809,729, dated Nov. 3, 2020; 19 pages.
China National Petroleum Corporation, Perforation Technology for Complex Reservoirs, Science & Technology Management Department, 2011, 21 pages.
Dynaenergetics Europe GMBH, Response to Opposition of EP Patent 3568664, dated Jan. 4, 2022, 14 pages.
Halliburton, Halliburton Velocity™ Aligned Gun SysteM, Economic, Compact, And Versatile System For Orienting Perforations In Horizontal Wells, 2022, 2 pgs., www.halliburton.com.
International Searching Authority; International Preliminary Report on Patentability of the International Searching Authority for PCT/EP2021/058158; mailed on Oct. 13, 2022; 8 pages.
International Searching Authority; International Preliminary Report on Patentability of the International Searching Authority for PCT/EP2021/057570; mailed on Oct. 6, 2022; 14 pages.
Norwegian Industrial Property Office, Office Action for NO Patent App. No. 20171759, dated Jan. 14, 2020, 4 pgs.
Norwegian Industrial Property Office, Search Report for NO Patent App. No. 20171759, dated Jan. 14, 2020, 2 pgs.
Norwegian Industrial Property Office; Office Action for NO Application No. 20180507; dated Jan. 23, 2023; 3 pages.
Norwegian Industrial Property Office; Search Report for NO Application No. 20180507; dated Jan. 23, 2023; 2 pages.
Qinetiq; Comments on Opposition of EP Patent 3568664; dated Feb. 24, 2022; 4 pages.
United States Patent and Trademark Office; Non-Final Office Action for U.S. Appl. No. 17/627,780; dated Jan. 19, 2023; 9 pages.
United States Patent and Trademark Office; Non-Final Office Action for U.S. Appl. No. 17/641,855; dated Feb. 14, 2023; 11 pages.
United States Patent and Trademark Office; Requirement for Restriction/Election for U.S. Appl. No. 17/336,617; dated Feb. 13, 2023; 7 pages.
International Searching Authority; International Preliminary Report on Patentability of the International Searching Authority for PCT/EP2020/086496; mailed on Jun. 30, 2022; 9 pages.
International Searching Authority; International Search Report and Written Opinion of the International Searching Authority for PCT/EP2022/055014; mailed on Jul. 4, 2022; 17 pages.
International Searching Authority; International Search Report and Written Opinion of the International Searching Authority for PCT/EP2022/055191; mailed on May 20, 2022; 10 pages.
United States District Court for the Southern District of Texas; Memorandum Opinion and Order for Civil Action No. H-20-2123; dated Sep. 19, 2022; 115 pages.
United States Patent and Trial Appeal Board; Final Written Decision on PGR2021-00078; issued Oct. 28, 2022; 139 pages.
Amit Govil, Selective Perforation: A Game Changer in Perforating Technology—Case Study, presented at the 2012 European and West African Perforating Symposium, Schlumberger, Nov. 7-9. 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Eric H. Findlay, Jury Trial Demand in Civil Action No. 6:20-cv-00069-ADA, dated Apr. 22, 2020, 32 pages.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429,161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Owen Oil Tools & Pacific Scientific; RF-Safe Green Det, Side Block for Side Initiation, Jul. 26, 2017, 2 pgs.

(56) References Cited

OTHER PUBLICATIONS

Owen Oil Tools, Recommended Practice for Oilfield Explosive Safety, Presented at 2011 MENAPS Middle East and North Africa Perforating Symposium, Nov. 28-30, 2011, 6 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9581422, Case PR2018-00600, Aug. 21, 2018, 9 pages.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trial Appeal Board; Final Written Decision on IPR2018-00600; issued Aug. 20, 2019; 31 pages.
U.S. Appl. No. 16/287,150, filed Feb. 27, 2019, Frank Haron Preiss.
U.S. Appl. No. 29/722,460, filed Jan. 30, 2020, Christian Eitschberger.
U.S. Appl. No. 29/722,461, filed Jan. 30, 2020, Christian Eitschberger.
U.S. Appl. No. 62/699,484, filed Jul. 7, 2018, Christian Eitschberger.
U.S. Appl. No. 62/780,427, filed Dec. 17, 2018, Christian Eitschberger.
Brazilian Patent and Trademark Office; Search Report for BR Application No. BR112015033010-0; mailed May 5, 2020; (4 pages).
Buche & Associates, P.C .; Rule 501 Citation of Prior Art and Written "Claim Scope Statements" in U.S. Pat. No. 10,844,697; dated Mar. 3, 2021; 24 pages.
Canadian Intellectual Property Office; Notice of Allowance for CA Appl. No. 2,821,506; mailed Jul. 31, 2019; 1 page.
Canadian Intellectual Property Office; Office Action for CA Appl. No. 2,821,506; mailed Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,070,118; dated Mar. 16, 2021; 3 pages.
Canadian Intellectual Property Office; Office Action for CA Application No. 3,070,118; dated Nov. 17, 2021; 3 pages.
Core Lab, ZERO180 Gun System Assembly and Arming Procedures—MAN-Z180-000 (R09), Jul. 9, 2020, 38 pages.
Core Lab, ZERO180 Gun System Assembly and Arming Procedures MAN-Z180-000 (R10); Copyright 2015-2021 Owen Oil Tools; dated May 7, 2021; 38 pages.
Core Lab, ZERO180™ Gun SystemAssembly and Arming Procedures—MAN-Z180-000 (RO7), Dec. 4, 2019, 33 pgs., https://www.corelab.com/owen/CMS/docs/Manuals/gunsys/zero180/MAN-Z180-000.pdf.
Corelab Owen Oil Tools; Expendable Perforating Guns Description; https://www.corelab.com/owen/cms/docs/Canada/10A_erhsc-01.0-c.pdf; 2008; 7 pages.
Dynaenergetics Europe GMBH; Complaint and Demand for Jury Trial for Civil Action No. 4:21-cv-00280; dated Jan. 28, 2021; 55 pages.
Dynaenergetics, DS NLine™ Oriented Perforating System, Precise Charge Alignment for Plug-and-Perf Operations, Jul. 18, 2019, 2 pgs., dynaenergetics.com.
Dynaenergetics, DS NLine™ System, Internal Frequently Asked Questions, Mar. 10, 2020, 4 pgs., dynaenergetics.com.
Dynaenergetics, No Debris Gun System (NDG), Hamburg, Germany, Feb. 6, 2008, 26 pgs.
Dynaenergetics, Perforating Gun Systems, Dec. 20, 2019, 6 pgs.
EP Patent Office—International Searching Authority, PCT Search Report and Written Opinion for PCT Application No. PCT/EP2014/065752, mailed May 4, 2015, 12 pgs.
Federal Institute of Industrial Property; Decision of Granting for RU Appl. No. 2016104882/03(007851); May 17, 2018; 15 pages (English translation 4 pages).
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office; Examination Report for GB Appl. No. 1717516.7; Apr. 13, 2018; 3 pages.
GB Intellectual Property Office; Notification of Grant for GB Appl. No. 1600085.3; mailed Jan. 24, 2017; 2 pages.
GB Intellectual Property Office; Notification of Grant for GB Appl. No. 1717516.7; Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; mailed Dec. 21, 2017; 5 pages.
Halliburton Wireline & Perforating; VELOCITY Perforating System Plug and Play Guns for Pumpdown Operations; dated Mar. 2021; 8 pages.

(56) References Cited

OTHER PUBLICATIONS

Halliburton; Wireline and Perforating Advances in Perforating; dated Nov. 2012; 12 pages.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; Oct. 26, 2018; 2 pages.
Industrial Property Office, Czech Republic; Office Action; CZ App. No. PV 2017-675; Dec. 17, 2018; 2 pages.
Instituto Nacional De La Propiedad Industrial; Office Action for AR Appl. No. 20140102653; issued May 9, 2019 (1 page).
Intellectual Property India, Office Action of IN Application No. 201647004496, dated Jun. 7, 2019, 6 pgs.
International Searching Authority, International Preliminary Report on Patentability for PCT App. No. PCT/EP2014/065752; Mar. 1, 2016, 10 pgs.
International Searching Authority, International Search Report and Written Opinion for PCT App. No. PCT/IB2019/000569; Oct. 9, 2019, 12 pages.
International Searching Authority, International Search Report and Written Opinion of International App. No. PCT/IB2019/000569, mailed Oct. 9, 2019, 12 pages.
International Searching Authority; International Preliminary Report on Patentability for PCT Appl. No. PCT/CA2014/050673; issued Jan. 19, 2016; 5 pages.
International Searching Authority; International Preliminary Report on Patentability for PCT Application No. PCT/EP2019/069165; mailed on Jan. 28, 2021; 9 pages.
International Searching Authority; International Preliminary Report on Patentability for PCT Application No. PCT/IB2019/000569; dated Jan. 28, 2021; 8 pages.
International Searching Authority; International Preliminary Report on Patentability of the International Searching Authority for PCT/EP2020/085624; mailed on Jun. 23, 2022; 6 pages.
International Searching Authority; International Preliminary Report on Patentability of the International Searching Authority for PCT/EP2020/066327; mailed on Dec. 21, 2021; 10 pages.
International Searching Authority; International Search Report and Written Opinion for PCT App. No. PCT/CA2014/050673; mailed Oct. 9, 2014; 7 pages.
International Searching Authority; International Search Report and Written Opinion for PCT App. No. PCT/EP2019/069165; Oct. 22, 2019; 13 pages.
International Searching Authority; International Search Report and Written Opinion for PCT Application No. EP2020066327; mailed on Jan. 11, 2021; 17 pages.
International Searching Authority; International Search Report and Written Opinion of the International Searching Authority for PCT/EP2020/086496; mailed on Apr. 7, 2021; 10 pages.
International Searching Authority; International Search Report and Written Opinion of the International Searching Authority for PCT/EP2020/085624; mailed on Apr. 12, 2021; 11 pages.
International Searching Authority; International Search Report and Written Opinion of the International Searching Authority for PCT/EP2021/079019; mailed on Feb. 28, 2022; 14 pages.
Norwegian Industrial Property Office; Notice of Allowance for NO Application No. 20171759; dated Apr. 23, 2021; 2 pages.
Norwegian Industrial Property Office; Office Action and Search Report for NO App. 20160017; Jun. 15, 2017; 5 pages.
United States Patent and Trademark Office; Advisory Action Before the Filing of an Appeal Brief for U.S. Appl. No. 17/004,966; mailed on May 21, 2021; 3 pages.
United States Patent and Trademark Office; Advisory Action Before the Filing of an Appeal Brief for U.S. Appl. No. 17/254,198; mailed on Aug. 2, 2022; 3 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/004,966; dated Mar. 12, 2021; 18 pages.
United States Patent and Trademark Office; Final Office Action for U.S. Appl. No. 17/162,579; dated Jul. 15, 2022; 15 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 17/352,728; dated Mar. 9, 2022; 9 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 17/004,966; dated Jul. 23, 2021; 22 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/162,579; dated Feb. 28, 2022; 16 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 15/920,812, mailed Aug. 18, 2020; 5 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 15/920,812; dated Aug. 4, 2021; 5 pages.
United States Patent and Trademark Office; Notice of Allowance for U.S. Appl. No. 16/455,816; mailed on Sep. 22, 2020; 12 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 17/004,966; dated Nov. 8, 2021; 12 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 17/221,219; dated Jan. 13, 2022; 11 pages.
United States Patent and Trademark Office; Office Action for U.S. Appl. No. 17/004,966; dated Dec. 8, 2020; 30 pages.
United States Patent and Trademark Office; Office Action in Ex Parte Reexamination for U.S. Pat. No. 10,844,697; mailed Jan. 26, 2022; 10 pages.
United States Patent and Trademark Office; Supplemental Notice of Allowability for U.S. Appl. No. 14/904,788; dated Jul. 21, 2016; 2 pages.
Vigor Petroleum; Perforating Gun Accessories Product Description; https://www.vigordrilling.com/completion-tools/perforating-gun-accessories.html; 2021; 1 page.
WIPO, International Search Report for International Application No. PCT/CA2014/050673, mailed Oct. 9, 2014, 3 pgs.
WIPO, Written Opinion of International Searching Authority for PCT Application No. PCT/CA2014/050673, mailed Oct. 9, 2014, 4 pgs.
Yang, Wenbo et al.; U.S. Appl. No. 60/314,200; filed Aug. 22, 2001; 15 pages.
Yellow Jacket Oil Tools, Orienting Sub, 2019, 2 pgs., https://www.yjoiltools.com/Wireline-Subs/Orienting-Sub.
United States Patent & Trademark Office, Patent Trial & Appeal Board, IPR2022-01373, U.S. Pat. No. 11,078,762 B2, Final Written Decision, Feb. 5, 2024; 65 pages.
United States Patent and Trademark Office; Office Action issued for U.S. Appl. No. 18/327,451 dated Aug. 1, 2024; 14 pages.
United States Patent and Trademark Office; Non-Final Office Action issued for U.S. Appl. No. 18/069,518 dated Mar. 11, 2024; 6 pages.

(56) References Cited

OTHER PUBLICATIONS

United States Patent and Trademark Office; Final Office Action issued for U.S. Appl. No. 18/069,518 dated Jul. 23, 2024; 7 pages.
ZERO180™ Gun System Assembly and Arming Procedures; MAN-Z180-000 (R11); Owen Oil Tools; User Manual dated Oct. 4, 2022; 33 pages.

* cited by examiner

PERFORATING GUN ASSEMBLY WITH ROTATING SHAPED CHARGE HOLDER

CROSS-REFERENCE TO RELATED APPLICATIONS

The present application is a national stage application of and claims priority to Patent Cooperation Treaty (PCT) Application No. PCT/EP2020/066327 filed Jun. 12, 2020, which claims the benefit of U.S. Provisional Application No. 62/861,601 filed Jun. 14, 2019 and U.S. Provisional Application No. 62/928,462 filed Oct. 31, 2019. The entire contents of each of the applications listed above are incorporated herein by reference.

BACKGROUND OF THE DISCLOSURE

Hydrocarbons, such as fossil fuels (e.g., oil) and natural gas, are extracted from underground wellbores extending deeply below the surface using complex machinery and explosive devices. Once the wellbore is established by placement of casing pipes after drilling, a perforating gun assembly, or train or string of multiple perforating gun assemblies, is lowered into the wellbore, and positioned adjacent one or more hydrocarbon reservoirs in underground formations.

Assembly of a perforating gun requires assembly of multiple parts. Such parts typically include a housing or outer gun barrel. An electrical wire may also be positioned in the housing, the electrical wire being provided for electrical communication with the surface to initiate a percussion initiator, a percussion detonator, a detonating cord, and/or one or more charges within the housing. Where necessary, one or more boosters may also be initiated by the electrical wire. Assembly of the perforating gun typically includes threaded insertion of one component into another by screwing or twisting the components into place. Tandem seal adapters/subs are typically used in conjunction with perforating gun assemblies to connect multiple perforating guns together. The tandem seal adapters are typically configured to provide a seal between adjacent perforating guns. Some tandem seal adapters may be provided internally or externally between adjacent perforating guns, which, in addition to requiring the use of multiple parts or connections between the perforating guns, may increase the length of each perforating gun and may be more expensive to manufacture.

The perforating gun includes explosive charges, typically shaped, hollow or projectile charges, which are initiated to perforate holes in the casing and to blast through the formation so that the hydrocarbons can flow through the casing. The explosive charges may be arranged in a hollow charge carrier or other holding devices. Once the perforating gun(s) is properly positioned, a surface signal actuates an ignition of a fuse or detonator, which in turn initiates a detonating cord, which detonates the explosive charges to penetrate/perforate the casing and thereby allow formation fluids to flow through the perforations thus formed and into a production string. Perforating gun assemblies may include charge carrying devices configured to swivel or rotate within the gun assembly to achieve a desired firing orientation of the shaped charges. Carrying devices may be configured to gravitationally orient to a phase angle of either 0° or 180° to perforate the top or bottom of the wellbore for fracing.

Typical known rotating charge carrying devices can gravitationally orient an opening of a shaped charge to a desired firing angle, in horizontal or highly deviated wellbores, but often include a rotating charge tube into which the shaped charges are loaded, which is subsequently loaded into a perforating gun. U.S. Pat. No. 5,964,294 to Schlumberger, for example, describes a rotatable inner loading tube assembly that is supported by bearings positioned in an outer gun housing assembly and connected to upstream and downstream components of the gun assembly via a rotating hydraulic bulkhead. The loading tube overcomes frictional resistance by coupling with other rotating components, and wear and tear from the rotating movement of the assembly components may lead to tool failure.

Known perforating gun housings include banded scallops that are machined on the outer surface of a portion of the perforating gun housing wall in a step-down/right-angle contour. A step-down contour is a recessed portion of the perforating gun housing wall that is machined out or milled out using a milling tool to form a recessed base that is parallel to the exterior perforating gun housing wall, and to form side walls perpendicular to/at a 90-degree angle to the exterior perforating gun housing wall and the recessed base. Perforating gun housings incorporating a step-down contour are inexpensive to manufacture, however the step-down contour may result in gun failure at elevated pressure levels due to collapse of the perforating gun in the high-pressure wellbore environment.

There is a need for an improved perforating gun assembly that does not require the use of tandem seal adapters or tandem subs to facilitate a sealed connection between perforating gun assemblies. There is a further need for a perforating gun assembly that includes a design for a rotating shaped charge positioning device that is connectable to stationary non-rotating gun assembly components upstream and downstream of the positioning device. A further need exists for a perforating gun assembly with a perforating gun housing wall having a continuous banded scallop of a particular geometry or contour that is capable of withstanding elevated pressure environments to prevent gun housing collapse during positioning, use, and retrieval of the perforating gun assembly.

BRIEF DESCRIPTION OF THE EXEMPLARY EMBODIMENTS

An exemplary embodiment of a shaped charge positioning device may include a shaped charge holder, an initiator holder coupled to the shaped charge holder via a first rotation coupling, and a shaped charge receptacle provided on the shaped charge holder. The shaped charge receptacle is rotatable around a central longitudinal axis of rotation of the shaped charge positioning device.

An exemplary embodiment of a perforating gun assembly may include a gun housing with an interior chamber. A shaped charge holder that is rotatable relative to the gun housing is provided in the interior chamber. A shaped charge receptacle is provided on the shaped charge holder.

An exemplary embodiment of a wellbore tool string may include a first gun housing with a first interior housing chamber, and a second gun housing with a second interior housing chamber. A first shaped charge holder is provided in the first interior housing chamber, wherein the first shaped charge holder is rotatable relative to the first gun housing. A second shaped charge holder is provided in the second interior housing chamber, wherein the second shaped charge holder is rotatable relative to the second gun housing. The first perforating gun housing and the second gun housing are rotatably coupled.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
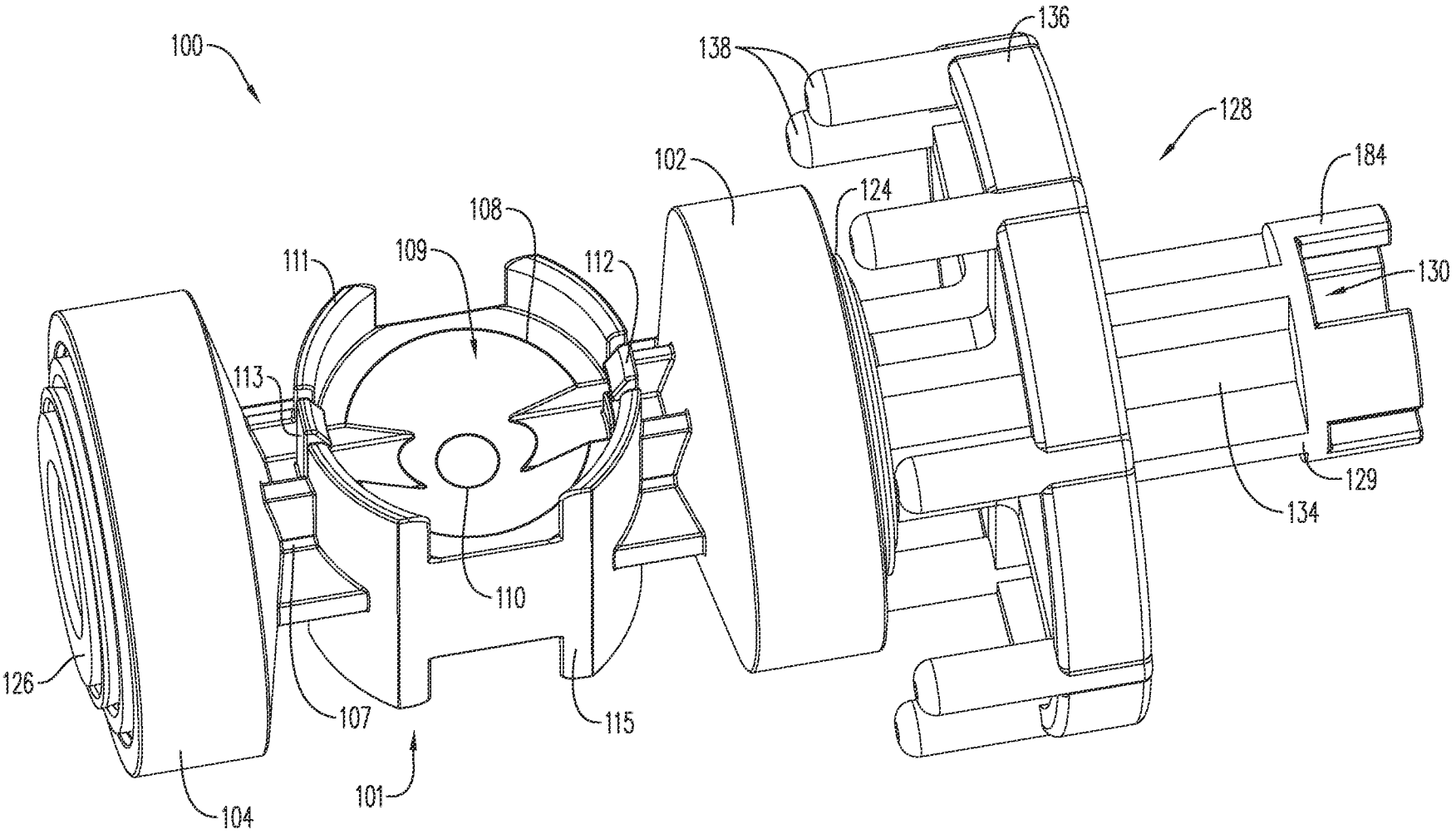
FIG. 1 is a perspective view of a rotating shaped charge positioning device, illustrating a shaped charge holder portion and an initiator holder portion, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

As used herein, the term "energetically" may refer to a detonating/detonative device that, when detonated and/or activated, generates a shock wave impulse that is capable of reliably initiating an oilfield shaped charge, booster or section of detonating cord to a high order detonation.

Embodiments described herein relate generally to devices, systems, and methods for a rotating charge carrier that may be equipped with a gravitational positioning sensor and a perforating gun housing. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of a rotating charge carrier as described throughout this disclosure.

Figure 2:
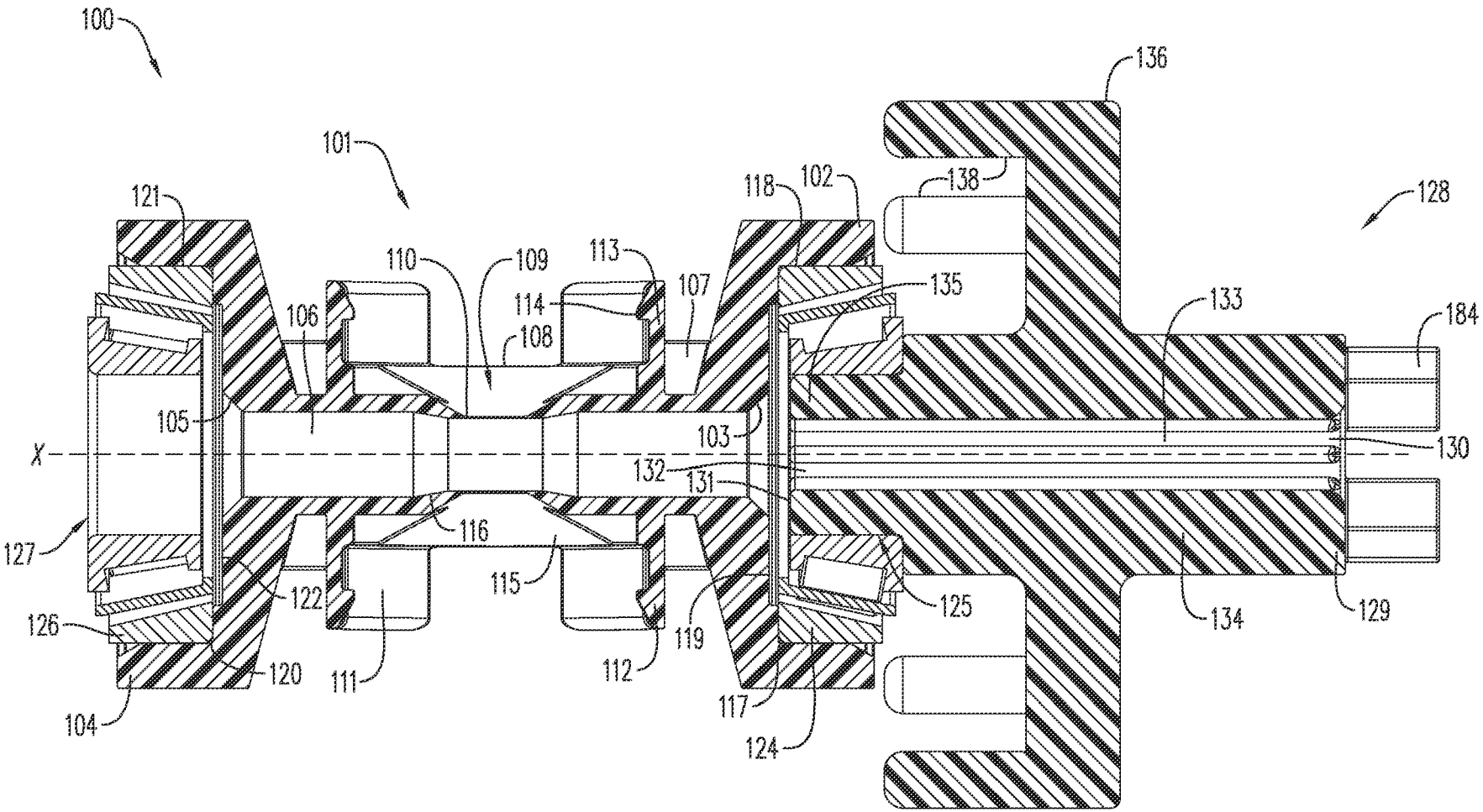
FIG. 2 is a cross-sectional side view of the rotating shaped charge positioning device according to the embodiment shown in FIG. 1.

FIGS. 1-2 show an exemplary embodiment of a rotating shaped charge positioning device (100). The rotating shaped charge positioning device (100) may include a shaped charge holder portion (101) and an initiator holder portion (128) that are rotatably coupled in an end-to-end engagement. According to an aspect, the shaped charge holder portion (101) and the initiator holder portion (128) are axially aligned about a common central axis X such that rotation of the shaped charge holder portion (101) relative to the initiator holder portion (128), or rotation of the initiator holder portion (128) relative to the shaped charge holder portion (101) is about a single central longitudinal axis X of the rotating shaped charge positioning device (100).

Figure 4:
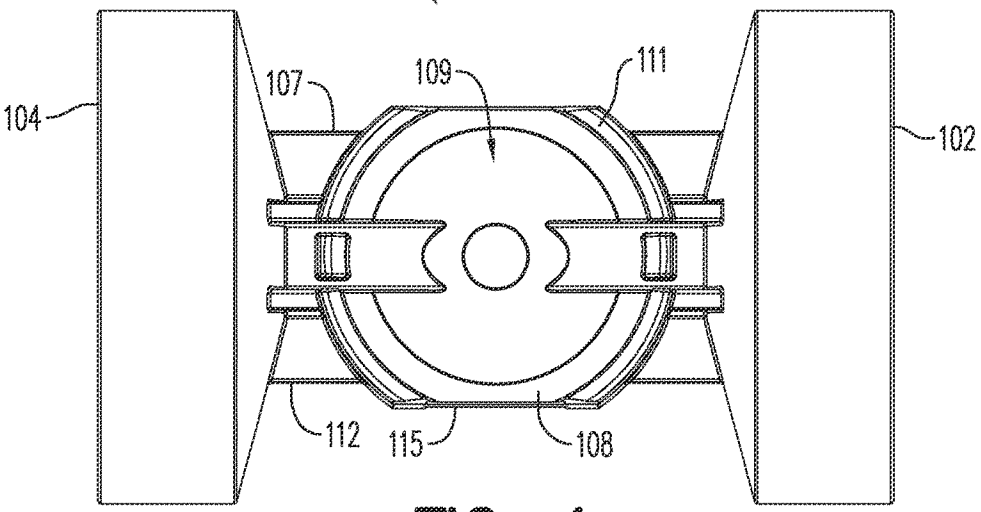
FIG. 4 is a top view of the shaped charge holder portion of the rotating shaped charge positioning device according to the embodiment shown in FIG. 3.
Figure 3:
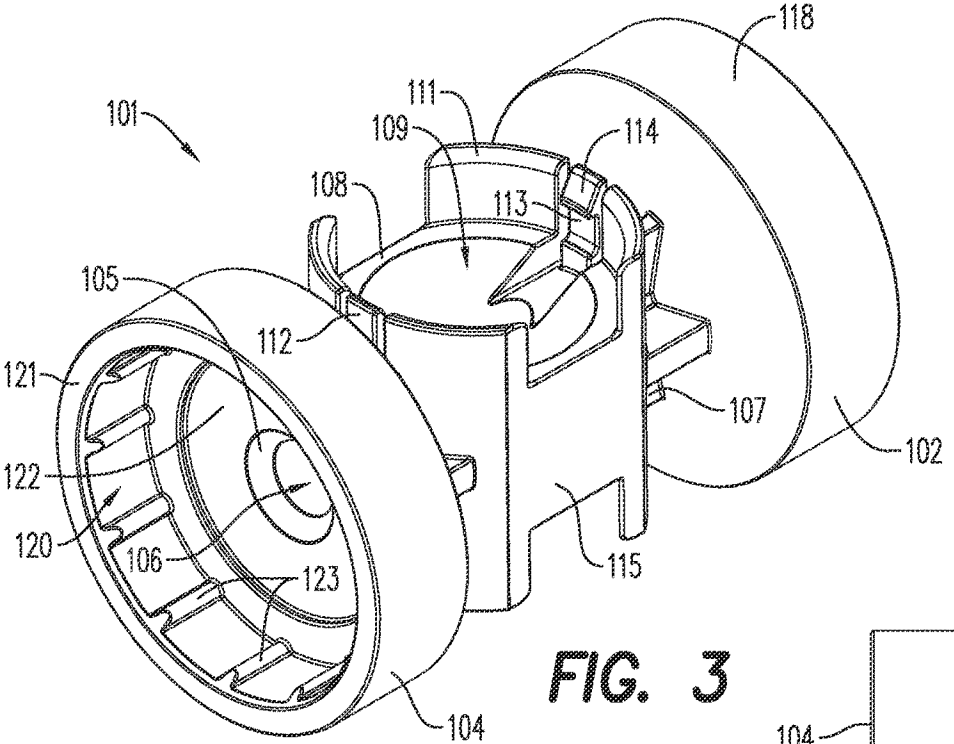
FIG. 3 is a perspective view of a shaped charge holder portion of the rotating shaped charge positioning device, according to an embodiment.

With reference to FIGS. 3-4, the shaped charge holder portion (101) is shown in greater detail. The shaped charge holder portion (101) in the exemplary embodiment includes a shaped charge holder portion first end (102) having a first opening (103) and a shaped charge holder portion second end (104) having a second opening (105) and spaced apart from the shaped charge holder portion first end (102). A channel (106) defined by a circumferential channel wall (107) extends between a first opening (103) adjacent the shaped charge holder portion first end (102) and a second opening (105) adjacent the shaped charge holder portion second end (104). According to an aspect, a central longitudinal axis of the channel (106) may be colinear with a central longitudinal axis X of the shaped charge holder portion (101) and/or the rotating shaped charge positioning device (100). According to an aspect, the central longitudinal axis of the channel (106) may also be colinear with a longitudinal axis of rotation X of the shaped charge holder portion (101) and/or the rotating shaped charge positioning device (100).

The shaped charge holder portion (101) includes a shaped charge receptacle (108) formed between the shaped charge holder portion first end (102) and the shaped charge holder portion second end (104). The shaped charge receptacle (108) is formed externally of the channel (106) such that a shaped charge positioned in the shaped charge receptacle (108) has a center of gravity offset from the central longitudinal axis X of the channel (106). In other words, the shaped charge receptacle (108) may extend from an exterior surface of the circumferential wall (107) radially adjacent to the channel (106) of the shaped charge holder portion (101). According to an aspect, the shaped charge receptacle (108) may be integrally formed with the shaped charge holder portion (101) as a unitary structure.

The shaped charge receptacle (108) may be configured to receive a shaped charge of a desired configuration and/or size. The geometry of the perforating jet and/or perforation (hole or perforating hole) that is produced by the shaped charge upon detonation depends, at least in part, on the shape of the shaped charge case, the shape of the liner and/or the composition of explosives included in the liner. The geometry of the perforating jet and hole may also depend on the quantity and type of explosive load included in the shaped charge. The explosive gram weight, the interior surface of the shaped charge case, and/or the design of the liner in the shaped charge may be modified in order to produce differently sized or shaped perforations.

According to an aspect, the shaped charge receptacle (108) includes a depression/recess (109) sized and shaped to receive a base of the shaped charge. The depression/recess (109) includes a recess opening (110) that is configured to facilitate communication between the contents of the shaped charge receptacle (108) (e.g., the shaped charge positioned in the recess) and the interior of the channel (106). The shaped charge receptacle (108) includes one or more mechanisms that help guide and/or secure a shaped charge within the shaped charge receptacle (108). The shaped charge receptacle (108) may include, for example, one or more positioning blocks/bars (111) outwardly extending from the exterior surface of the circumferential wall (107) of the shaped charge holder portion (101) to guide the arrangement, mounting, or placement of the shaped charge within the shaped charge receptacle (108). According to an aspect, the positioning blocks/bars (111) may form walls that surround a recess (109) of the shaped charge receptacle (108) into which the shaped charge is positioned and secured. The positioning blocks/bars (111) may be contoured to correspond to a general shape of the shaped charge, such as a conical or rectangular shaped charge. According to an aspect, the positioning blocks/bars (111) provide added strength and stability to the shaped charge receptacle (108) and help to support the shaped charge in the shaped charge receptacle (108).

According to an aspect and with continued reference to the embodiment shown in FIGS. 3 and 4, the shaped charge receptacle (108) includes a retention mechanism (112) outwardly extending from an exterior surface of the shaped charge holder (101). The recess (109) of the shaped charge receptacle (108), in combination with the retention mechanism (112) and the shaped charge positioning block/bar (111), aids in mechanically securing the shaped charge within the shaped charge receptacle (108). The retention mechanism (112) may be an elongated shaft (113) projecting from the shaped charge holder portion circumferential wall (107) with a hook (114) that extends substantially perpendicular from the elongated shaft (113) toward the center of the shaped charge receptacle (106). The retention mechanism (112) may be formed integrally with the shaped charge holder portion (101) in a position adjacent to the recess (109) of the shaped charge receptacle (108). In an embodiment, a plurality of retention mechanisms (112) may be arranged in a spaced apart configuration from each other. Each retention mechanism (112) may be adjacent a shaped charge positioning block/bar (111). According to an aspect and with continued reference to FIGS. 3 and 4, a retention mechanism (112) may be positioned between two shaped charge positioning blocks/bars (111). In an embodiment, each retention mechanism (112) of at least one pair of retention mechanisms is spaced apart from the other at a 180° angle, with a shaped charge positioning block (111) positioned between each retention mechanism (112). In an alternative embodiment, each retention mechanism (112) may be spaced at about a 90° degree angle from an adjacent retention mechanism (112).

According to an aspect, the shaped charge holder portion (101) includes a second receptacle or counterweight receptacle (115) that may be the same as the shaped charge receptacle (108) with respect to dimension, size and shape. The counterweight receptacle (115) is formed externally of the channel (106) such that a counterweight or shaped charge positioned in the counterweight receptacle (115) has a center of gravity offset from the central longitudinal axis X of the channel (106). In other words, the counterweight receptacle (115) may extend from an exterior surface of the circumferential wall (107) radially adjacent to the channel (106) of the shaped charge holder portion (101). According to an aspect, the counterweight receptacle (115) may be integrally formed with the shaped charge holder portion (101). Similar to the shaped charge receptacle (108) described above and with reference to FIG. 2, the counterweight receptacle (115) may include a recess (109), one or more retention mechanisms (112) and one or more positioning blocks/bars (111). Thus, for purposes of convenience, and not limitation, the features and characteristics of the counterweight receptacle (115), the recess (109), the retention mechanism (112) and the positioning block/bar (111) of the counterweight receptacle (115) are not repeated here.

In an embodiment and as shown in FIG. 2, centers of the shaped charge receptacle (108) and the counterweight receptacle (115) may be radially arranged on a single plane transverse to the central axis X of the shaped charge holder portion (101) such that each of the shaped charge receptacle (108) and the counterweight receptacle (115) are rotatable around the central axis X of the shaped charge holder portion (101). In an alternative embodiment (not shown), each of the shaped charge receptacle (108) and the counterweight receptacle (115) may be positioned on a unique plane transverse the central axis X of the shaped charge holder portion (101). The counterweight receptacle (115) may be spaced about 180° apart from the shaped charge receptacle (108) in a circumferential direction around the central axis X such that respective receptacles are positioned radially opposite one another on the shaped charge holder portion (101) about the axis X. In an alternative embodiment, the counterweight receptacle (115) and shaped charge receptacle (108) may be positioned relative to one another on the shaped charge holder portion (101) at a degree measurement other than 180°.

In the exemplary embodiment, the circumferential wall (107) radially adjacent to the channel includes a tapered midsection (116) aligned with the recess (109) and/or opening (110) of the shaped charge receptacle (108) and/or the counterweight receptacle (115). According to an aspect, the tapered midsection (116) is dimensioned to contact an outer surface of a detonative device positioned therein. It is contemplated that dimensions of the channel (106) in other embodiments may vary according to the needs of the particular application. For example, the channel (106) according to an aspect may be defined by a circumferential wall with a substantially uniform diameter along its length.

In the exemplary embodiment shown in FIGS. 1-2, a first bearing housing recess (117) defined by a first bearing housing circumferential wall (118) and a first bearing housing recess wall (119) extends from the shaped charge holder first end (102) to the channel (106), and a second bearing housing recess (120) defined by a second bearing housing circumferential wall (121) and a second bearing housing recess wall (122) extends from the shaped charge holder second end (104) to the channel (106). An inner surface of each of the first bearing housing circumferential wall (118) and the second bearing housing circumferential wall (121) may have a surface engagement feature, such as surface projections (123), shown in FIG. 3, for frictionally engaging with a bearing component to secure the bearing component in the bearing housing recess.

A first rotation coupling includes a first bearing component (124) that is retained in the first bearing housing such that the first bearing component (124) is positioned in the first bearing housing recess (117) against the first bearing housing recess wall (119). The first bearing component (124) has a bearing central bore (125) for receiving and rotationally coupling to an adjacent wellbore component. A second rotation coupling includes a second bearing component (126) that is retained in the second bearing housing such that the second bearing component (126) is positioned in the second bearing housing recess (120) against the second bearing housing recess wall (122). The second bearing component (126) has a bearing central bore (127) for receiving and rotationally coupling to an adjacent wellbore component. According to an aspect, the bearing components (124, 126) may be, for example and not limitation, roller bearings, taper bearings, tapered roller bearings, bushing bearings, deep groove ball bearings. For example, in the exemplary embodiment, the bearing components (124, 126) are ball bearings. In an embodiment, the bearing components (124, 126) may each include an internal disk or puck that rotates to reduce friction between the bearing component and the item with which it is rotatably coupled. According to an aspect, each of the respective bearing central bores (125, 127) is axially aligned with the channel (106) along the central longitudinal axis X.

With reference to FIGS. 1-2 and 5-6, the rotating shaped charge positioning device (100) includes an initiator holder portion (128) rotatably coupled to the shaped charge holder portion (101) via the first bearing component (124). The initiator holder portion (128) includes an initiator holder first end (129) having an initiator holder first opening (130) and an initiator holder second end (131) having an initiator holder second opening (132) and spaced apart from the initiator holder first end (129). An initiator holder cavity (133) defined by an initiator holder circumferential wall (134) extends between the initiator holder first opening (130) and the initiator holder second opening (132). A tapered portion (135) formed at the initiator holder second end (131) is positioned in the first bearing component central bore (125) for frictionally engaging with the first bearing component (124) and coupling the initiator holder portion (128) to the shaped charge holder portion (101). In the exemplary embodiment shown in FIG. 2, the initiator holder tapered portion (135) is coupled to the shaped charge holder portion first end (102) such that the initiator holder second end (131) extends through the length of the first bearing component central bore (125) and terminates adjacent to the first bearing housing recess wall (119). In other words, the shaped charge holder portion first opening (103) is in a facing relationship with the initiator holder portion second opening (132) when the initiator holder portion (128) is coupled with the shaped charge holder portion (101), such that the channel (106) and the initiator holder cavity (133) are in communication through the first rotation coupling/first bearing configuration (124).

According to an aspect, a central longitudinal axis of the initiator holder cavity (133) may be colinear with a central longitudinal axis X of the shaped charge holder portion (101), the channel (106), and/or the rotating shaped charge positioning device (100). According to an aspect, the central longitudinal axis of the initiator holder cavity (133) may also be colinear with a longitudinal axis of rotation X of the shaped charge holder portion (101) and/or the rotating shaped charge positioning device (100). In the exemplary embodiment, a diameter of the initiator holder cavity (133) is uniform between the initiator holder first opening (130) and the initiator holder second opening (132), however, it is contemplated that dimensions of the initiator holder cavity (133) in other embodiments may vary according to the needs of the particular application.

Figure 6:
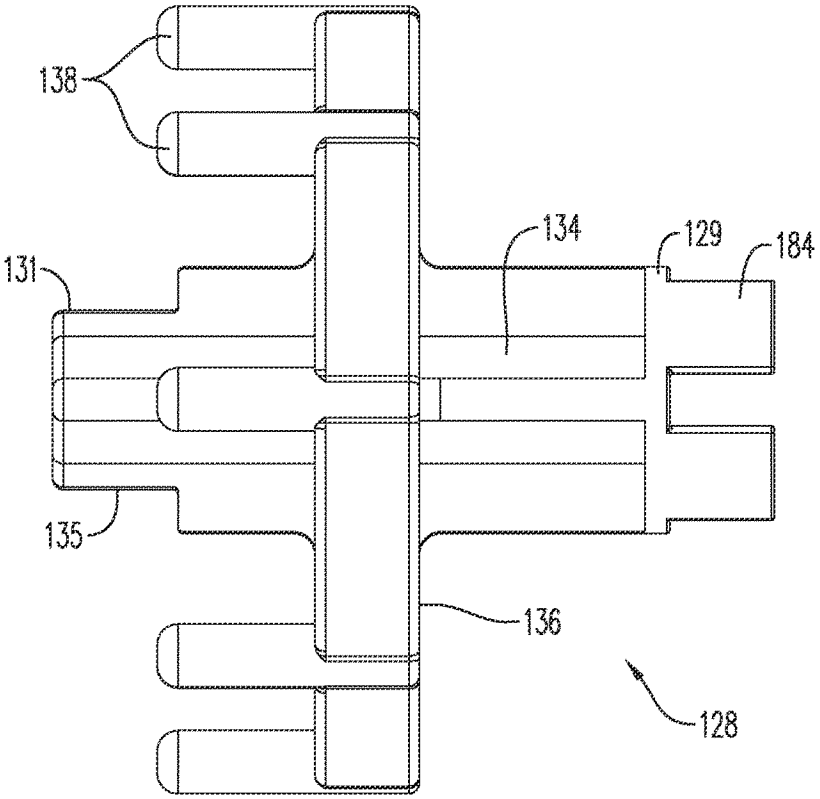
FIG. 6 is a side view of an initiator holder portion of the rotating shaped charge positioning device according to the embodiment shown in FIG. 5.
Figure 5:
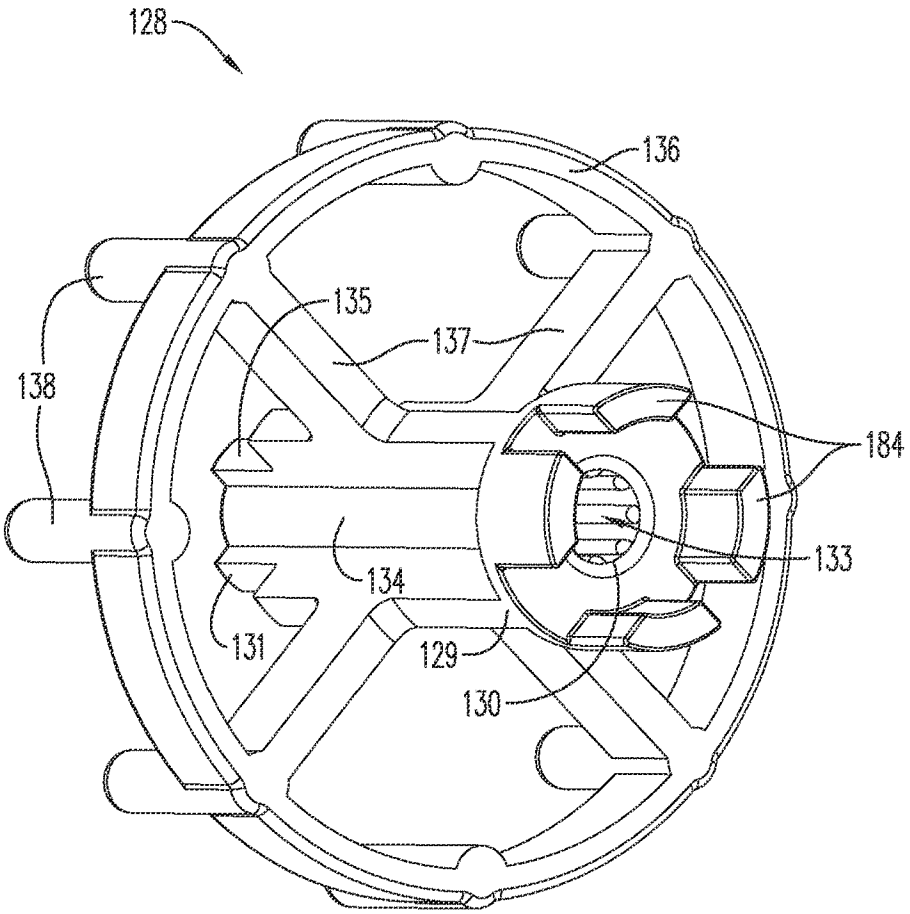
FIG. 5 is a perspective view of an initiator holder portion of the rotating shaped charge positioning device, according to an embodiment.
Figure 10:
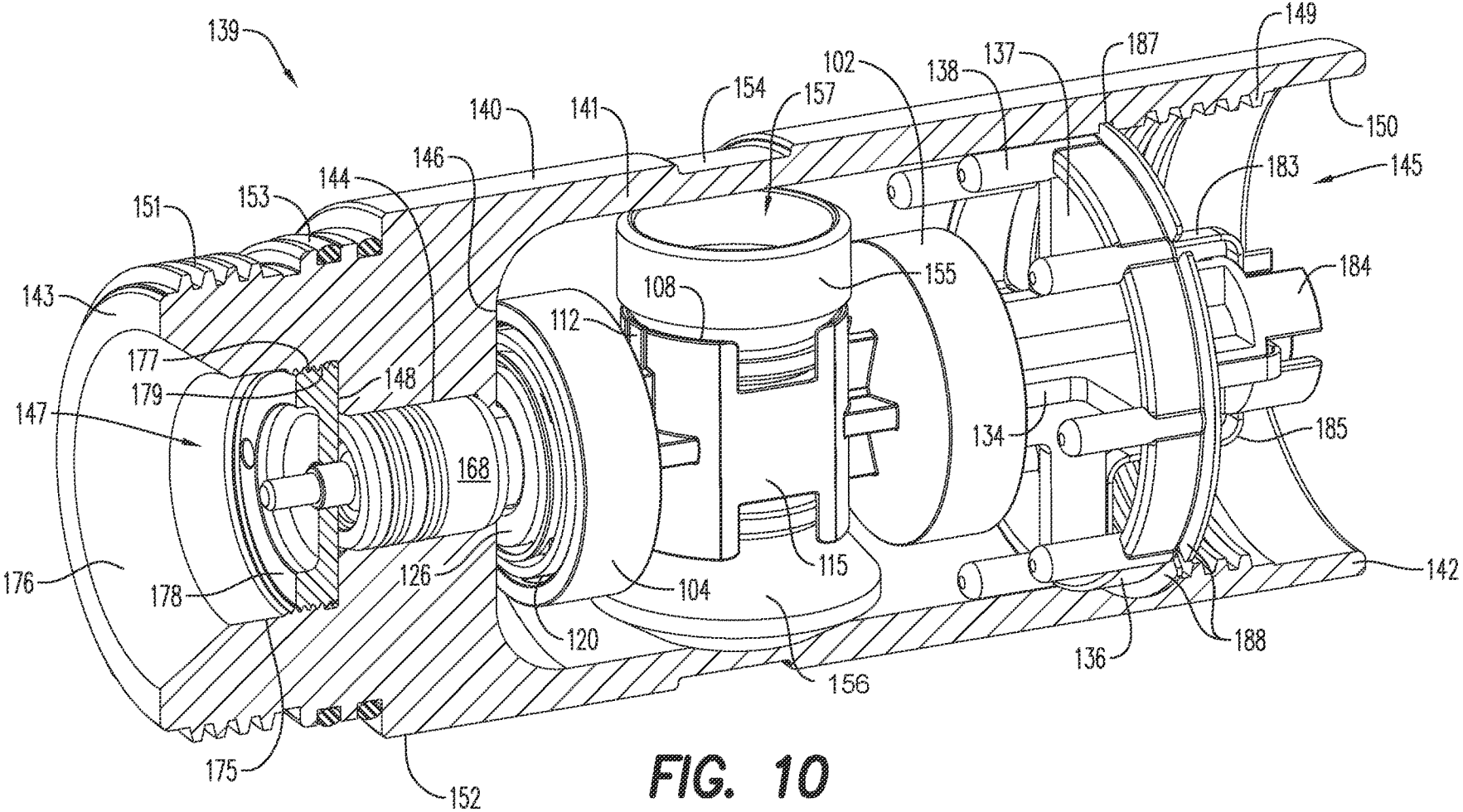
FIG. 10 is a perspective partial cross-section view of a perforating gun assembly according to an embodiment, illustrating a rotating shaped charge positioning device positioned therein, according to an embodiment.
Figure 11:
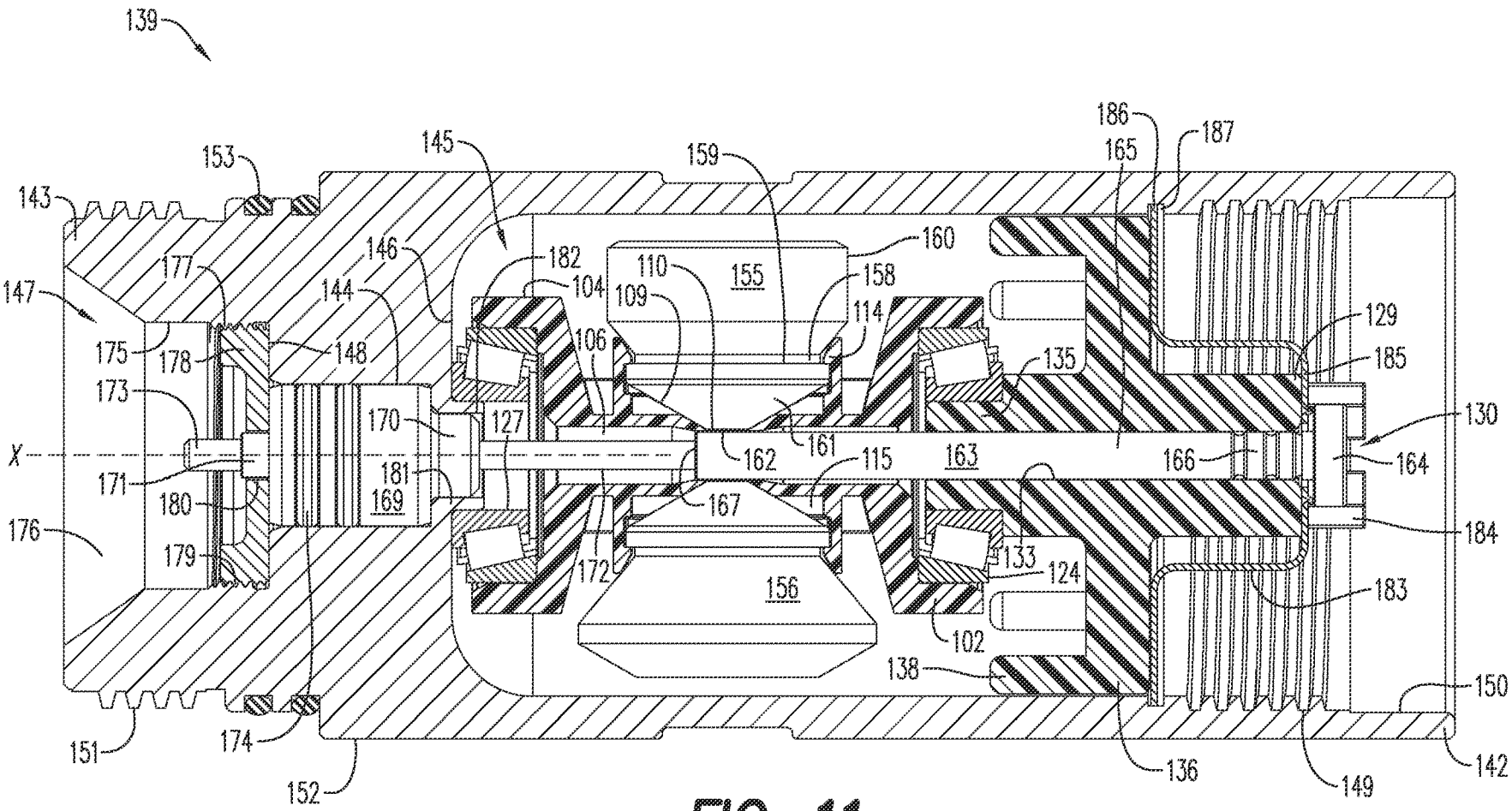
FIG. 11 is a side cross-sectional view of a perforating gun assembly according to the embodiment shown in FIG. 10, illustrating a side cross-sectional view of a rotating shaped charge positioning device according to the embodiment shown in FIG. 10.

With reference to FIGS. 5-6, the initiator holder portion (128) includes a ring (136) with a circumferential projection (138) for limiting mobility of a rotating shaped charge positioning device (100) in a perforating gun housing (140) (see, e.g., FIGS. 10-11). The ring (136) is positioned around the initiator holder circumferential wall (134) and an arm (137) extends radially between the ring (136) and the circumferential wall (134). According to an aspect and as illustrated in FIG. 2, the initiator cavity (133) and the initiator circumferential wall (134) are positioned at a center point of the ring (136), such that a central longitudinal axis of the ring (136) is colinear with a central longitudinal axis of rotation X of each of the initiator holder portion (128), the shaped charge holder portion (101), and the rotating shaped charge positioning device (100) in an assembled configuration.

Figure 7:
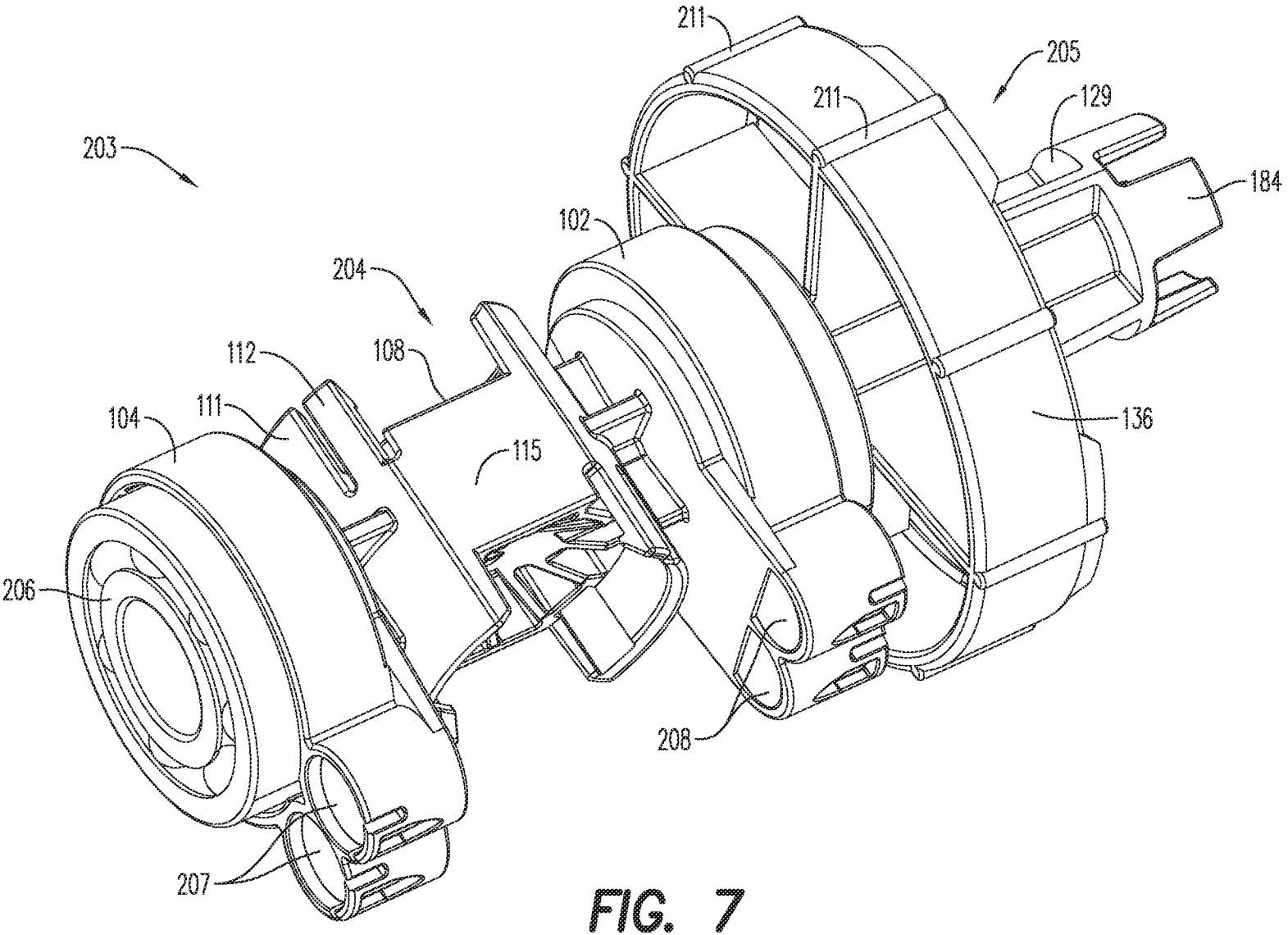
FIG. 7 is a perspective view of a rotating shaped charge positioning device, illustrating a shaped charge holder portion and an initiator holder portion, according to an embodiment.

In the exemplary embodiment shown in FIGS. 7-9, the rotating shaped charge positioning device (203) may be configured substantially as described hereinabove and as illustrated in FIGS. 1-6. Thus, for purposes of convenience, and not limitation, the features and functionality of the rotating shaped charge positioning device (203) are not repeated in detail hereinbelow. In the embodiment of FIG. 7, a shaped charge holder (204) is rotatably coupled to an initiator positioning device (205). The initiator positioning device (205) includes a projection (211) extending from an outer surface of the ring (136) and spaced apart circumferentially around the ring (136). A bearing configuration (206) may be provided in each of the shaped charge holder first end (102) and the shaped charge holder second end (104). According to an aspect, the bearing configuration (206) is a ball bearing or tapered roller bearing configuration.

Figure 9:
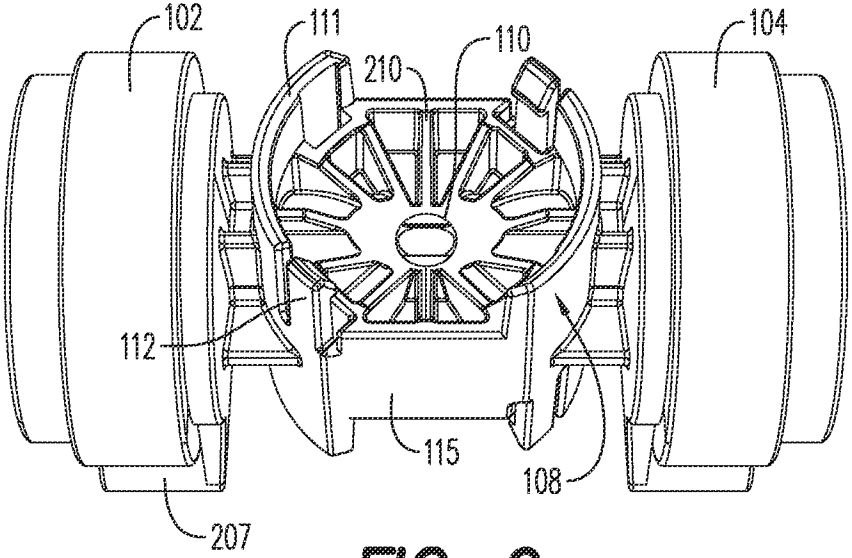
FIG. 9 is a front elevated perspective view of an initiator holder portion of the rotating shaped charge positioning device, according to the embodiment shown in FIG. 7.
Figure 8:
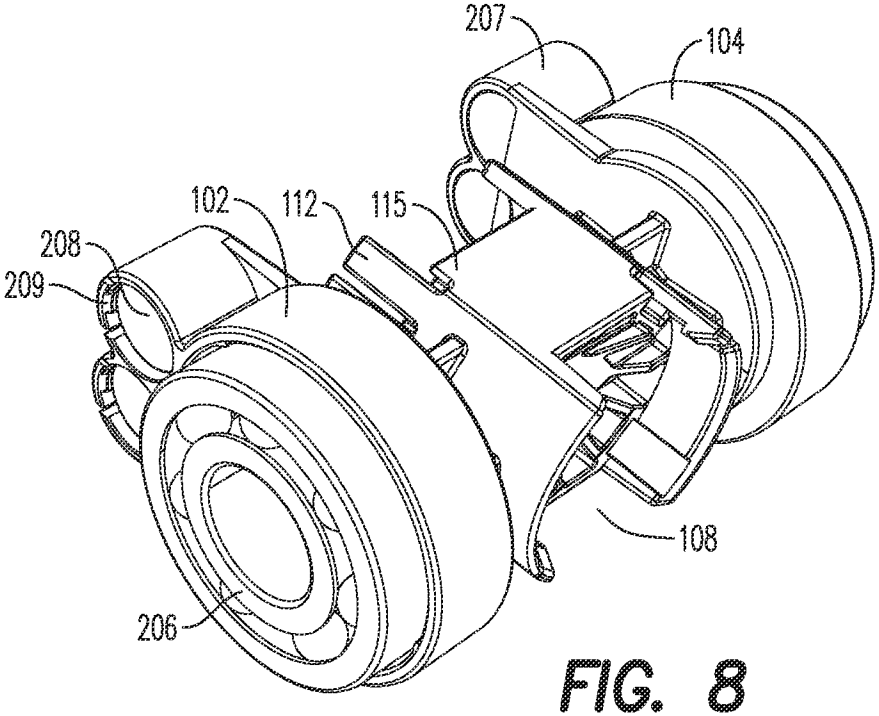
FIG. 8 is a perspective view of an initiator holder portion of the rotating shaped charge positioning device, according to the embodiment shown in FIG. 7.

With reference to FIGS. 8 and 9, the shaped charge receptacle (108) includes a lattice or frame structure (210). The recess opening (110) is provided in the center of the frame structure (210). A pair of positioning blocks (111) and retention mechanisms (112) are provided extending from the shaped charge receptacle (108). The retention mechanisms (112) are provided opposite one another and the positioning blocks (111) are provided opposite one another, wherein one positioning block (111) is provided adjacent each retention mechanism (112). A counterweight pocket (207) is provided on the shaped charge holder (204). According to an aspect, the counterweight pocket (207) may be formed on an outer surface of each of the shaped charge holder first end (102) and the shaped charge holder second end (104). The counterweight pocket (207) may extend from the shaped charge holder (204) radially adjacent to the counterweight receptacle (115) in a direction radially away from the channel (106). The counterweight pocket (207) may include one or more cylindrical bores for receiving a weight (208). According to an aspect, the weight (208) is sized and shaped to contact and frictionally engage a wall of the pocket (207) radially adjacent to the cylindrical bore for securement therein. In an embodiment, the wall of the pocket (207) may include a retainer or clip (209) including a projection for engaging with a surface of the weight (208). The weight (208) is retained in its desired position in the pocket (207) via engagement with the clip (209).

According to an aspect, the counterweight pocket (207) and weight (208) provide asymmetrical weight distribution in shaped charge holder (204) such that the shaped charge receptacle (108) and counterweight receptacle (115) will be oriented vertically. In an embodiment, each of the shaped charge receptacle (108) and counterweight receptacle (115) may have secured therein a shaped charge. According to an aspect, each of the shaped charges positioned in the shaped charge receptacle (108) and the counterweight receptacle (115) may have a similar or identical mass or weight. The pocket (207) and weight (208) offset the center of gravity of the shaped charge holder (204) to ensure that the gravitational orientation of the shaped charge receptacle (108) and counterweight receptacle (115) will be aligned vertically for firing at 0 degrees and 180 degrees respectively.

According to an aspect, the rotating shaped charge positioning device (100/203) may be formed by known methods including, but not limited to, injection molding, casting, 3-D printing, or 3-D milling. Each of the shaped charge holder portion (101/204) and the initiator holder portion (128/205) may be integrally formed as a unitary structure. In an exemplary embodiment, each of the shaped charge holder portion (101/204) and the initiator holder portion (128/205) may be made from a plastic material, such that upon detonation of the shaped charge positioned in the rotating shaped charge positioning device (100/203), the shaped charge holder portion (101/204) and/or the initiator holder portion (128/205) may partially melt or soften to capture shrapnel or dust generated by the detonation.

Embodiments of the disclosure are further associated with a perforating gun assembly (139) including a rotating shaped charge positioning device (100/203) loaded with a detonative device, such as a detonator or an initiator (163), and a shaped charge (155) and/or a counterweight (156) that is positioned within a perforating gun housing body (140) as illustrated in FIGS. 10-16. The rotating shaped charge positioning device (100/203) may be configured substantially as described hereinabove and as illustrated in FIGS. 1-6. Thus, for purposes of convenience, and not limitation, the features and functionality of the rotating shaped charge positioning device (100/203) are not repeated in detail hereinbelow.

With reference to FIGS. 10-13, the perforating gun assembly (139) includes a gun housing body (140) integrally formed as a singular and monolithic piece of metal material defined by a cylindrical housing wall (141). According to an aspect, the gun housing body (140) may be formed from a preforged metal blank. The gun housing body (140) includes a first housing end (142), a second housing end (143) spaced apart from the first housing end (142), and an axial bore (144) extending through the housing body (140). An interior housing chamber (145) defined by a housing chamber wall (146) extends inwardly in an axial direction from the first housing end (142), and a housing recess (147) defined by a housing recess wall (148) extends inwardly in an axial direction from the second housing end (143). The axial bore (144) extends from the housing chamber wall (146) to the housing recess wall (148). In other words, the axial bore (144) is formed between the housing chamber wall (146) and the housing recess wall (148) through an axial cross-section of the singular and monolithic body of the gun housing (140) that is an otherwise solid metal material.

The perforating gun assembly (139) includes a bulkhead assembly (168) positioned in the axial bore (144). According to an aspect, the bulkhead assembly (168) is a rotatable bulkhead assembly. Such bulkhead assemblies are described in U.S. Pat. No. 9,784,549, commonly owned and assigned to DynaEnergetics Europe, which is incorporated herein by reference in its entirety. The bulkhead assembly (168) includes a bulkhead body (169) having a first end (170) and a second end (171). A first electrically contactable bulkhead component (172), such as a metal contact plug, extends from the first end (170) of the bulkhead body (169), and a second electrically contactable bulkhead component (173), such as a downhole facing pin, extends from the second end (171) of the bulkhead body (169). A sealing element, such as o-ring (174), extends around the bulkhead body (169). The o-ring (174) is compressively engaged with a surface of the gun housing (140) radially adjacent to the axial bore (144) such that the axial bore (144) is sealed by the bulkhead assembly (168). According to an aspect, when the bulkhead assembly (168) is positioned in the axial bore (144), a pressure seal is maintained between the housing chamber (145) and the housing recess (147).

The housing recess (147) is further defined by a housing recess side wall (175) extending between the housing recess wall (148) and the second housing end (143). In the exemplary embodiment, the housing recess side wall (175) includes a housing recess tapered portion (176) formed adjacent to the second housing end (143), and a threaded surface portion (177) formed adjacent to the housing recess wall (148). A bulkhead retainer nut (178) is positioned in the housing recess (147) to secure the bulkhead assembly (168) in position in the axial bore (144). The bulkhead retainer nut (178) is positioned in the housing recess (147) adjacent each of the housing recess wall (148) and the axial bore (144), and is dimensionally configured to contact an interior surface of the recess side wall (175). In the exemplary embodiment shown in FIGS. 10-11, the threaded surface portion (177) receives a threaded side surface (179) of the bulkhead retainer nut (178) in a threaded engagement so that the bulkhead retainer nut (178) is threadingly secured to the recess side wall (175) of the gun housing body (140). A bulkhead retainer nut aperture (180) is formed through an axial cross-section of the bulkhead retainer nut (178) such that the second electrically contactable bulkhead component (173) extends through the bulkhead retainer nut aperture (180). According to an aspect, each of the bulkhead second end (171) and the second electrically contactable bulkhead component (173) may extend through the bulkhead retainer nut aperture (180).

Figure 13:
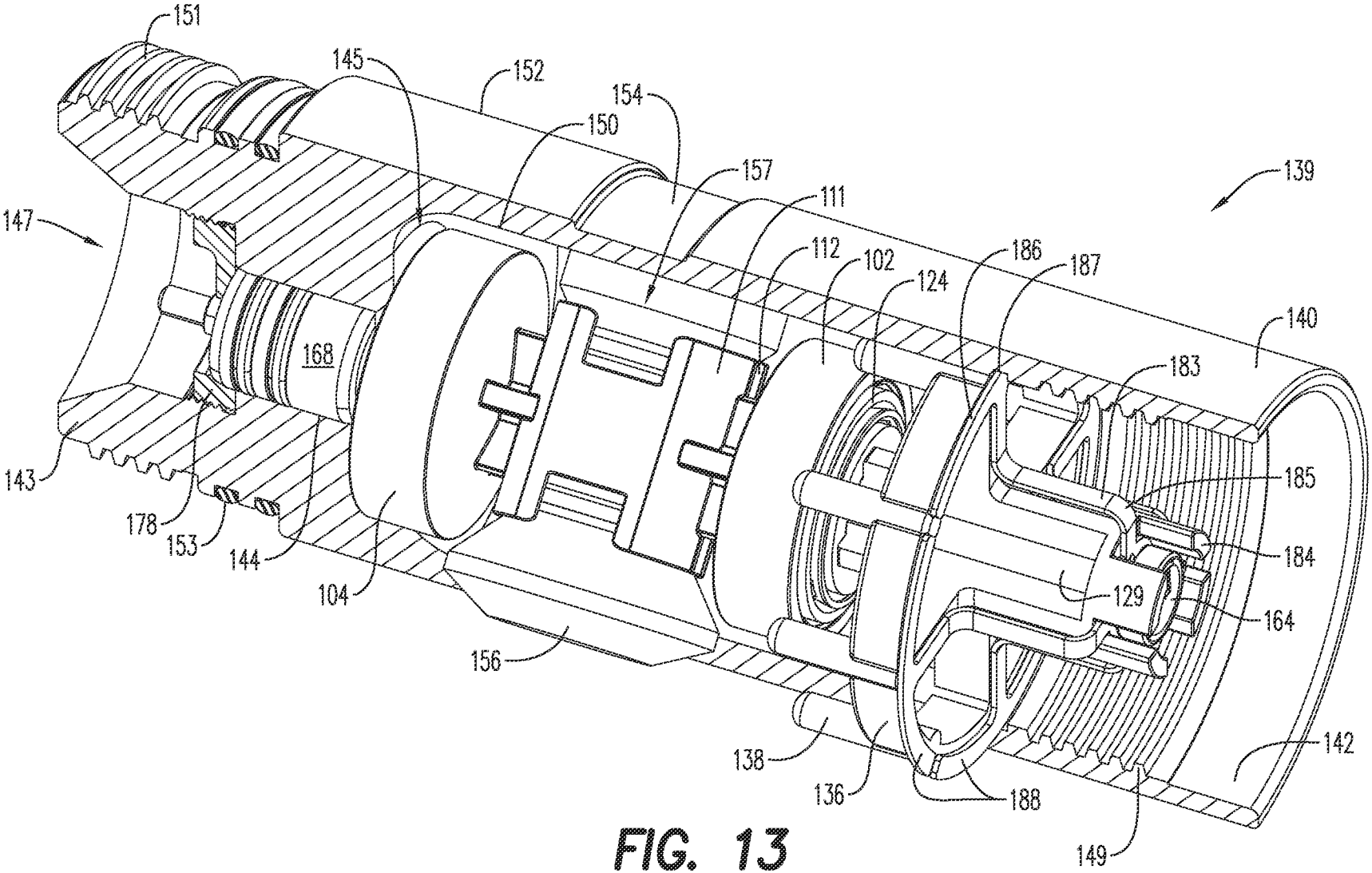
Figure 14:
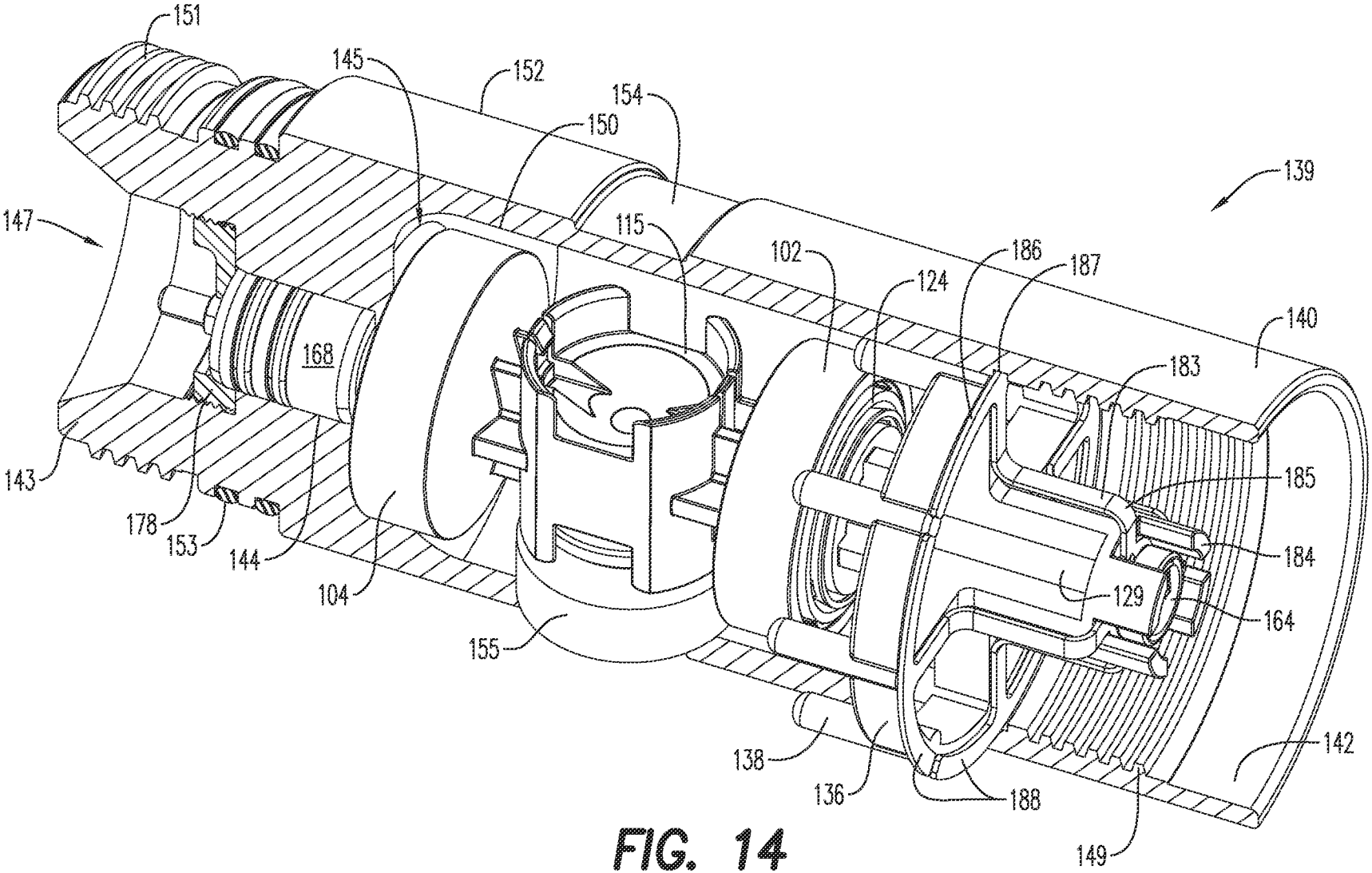

With reference to FIGS. 13-14, the gun housing body (140) in the exemplary embodiment includes a shoulder (181) formed on the housing chamber wall (146). A shoulder aperture (182) is formed in the shoulder (181), which extends from the axial bore (144) through the shoulder (181). According to an aspect, the shoulder aperture (182) may have a diameter that is smaller than a diameter of the bulkhead body (169), so as to prevent the bulkhead body (169) from passing through the axial bore (144). According to an aspect, the shoulder (181) is formed centrally on the housing chamber wall (146), and the shoulder aperture (182) is formed centrally in the shoulder (181), so that a central longitudinal axis of the shoulder (181) and/or the shoulder aperture (182) is colinear with the central longitudinal axis of rotation X as defined above.

According to an aspect, the first electrically contactable bulkhead component (172) has a diameter that is less than the diameter of the shoulder aperture (182) such that the first electrically contactable bulkhead component (172) extends through the shoulder aperture (182) and into the housing chamber (145). According to an aspect, each of the bulkhead first end (171) and the first electrically contactable bulkhead component (172) may extend through the shoulder aperture (182). In the exemplary embodiment, the first electrically contactable bulkhead component (172) extends from the bulkhead first end (171) through the shaped charge holder second opening (105) into the channel (106) adjacent to the recess (109) and/or opening (110) of the shaped charge receptacle (108). According to an aspect, the second end (104) of the shaped charge holder portion (101) may be coupled to the shoulder (181) for rotational engagement of the shaped charge holder (101) relative to the gun housing body (140). The central bore (127) of the second bearing component (126) has a diameter substantially equal to the diameter of the shoulder (181) such that the shoulder (181) may be frictionally engaged with a surface of the second bearing component (126) radially adjacent to the second bearing component central bore (127). In the exemplary embodiment, in an assembled configuration each of the shoulder (181) and the first electrically contactable bulkhead component (172) pass through the second bearing component central bore (127) so as to position the first electrically contactable bulkhead component (172) within the channel (108) along the central longitudinal axis of rotation X of the shaped charge holder portion (101) and/or the rotating shaped charge positioning device (100).

With reference to FIGS. 13-19, and as described above with reference to FIGS. 5-6, the initiator holder portion (128) of the rotating shaped charge positioning device (100) includes a ring (136) that extends around the initiator holder circumferential wall (134) to frictionally contact an inner surface (150) of the housing wall (141) to limit axial and/or radial mobility of the rotating shaped charge positioning device (100), and/or rotational mobility of the initiator holder portion (128), within the housing chamber (145). According to an aspect, an outer diameter measurement of the ring (136) is substantially equal to an inner diameter measurement of the housing wall (141), such that each of a side surface of the ring (136) and a circumferential projection (138) extending perpendicularly from the ring (136) toward the initiator housing second end (131) frictionally contacts the housing wall (141). In the exemplary embodiment, the ring (136) is positioned radially around an approximate midpoint of the initiator holder portion (128) away from each of the initiator holder first end (129) and the initiator holder second end (131). The circumferential projection (138) extends along the interior surface (151) (150) of the housing wall (140) in a parallel relationship to the initiator holder circumferential wall (134). In the exemplary embodiment, six circumferential projections (138) formed on the ring (136) are spaced equidistantly around the circumference of the ring (136) and extend axially from the ring (136) to a position radially adjacent to the shaped charge holder first end (102).

According to an aspect, a ground member/circular clip (183) may be positioned on or coupled to the rotating shaped charge positioning device (100/203) to engage with the interior surface (150) of the perforating gun housing body (140). The circular clip (183) is positioned adjacent the initiator holder first end (129). According to an aspect and as shown in FIG. 5, the initiator holder first end (129) may include a clip guide projection (184) for positioning of a plate portion (185) of the circular clip (183) adjacent the initiator holder first end (129). The plate portion (185) of the circular clip (183) contacts the initiator head (164) (FIG. 12) to facilitate a secure and reliable electrical ground contact between the initiator (163) and the interior surface (150) of the perforating gun housing (140). The circular clip (183) includes a circular clip projection (186) that is seated in a slot (187) etched into the interior surface (150) of the gun housing (140) adjacent the internal threaded surface portion (149) of the housing first end (142). The circular clip projection (186) may include a plurality of segments (188) that are compressed during installation of the circular clip (183) into the slot (187), and subsequently expand into a tension fit resting position to secure the circular clip (183) in the slot (187) and therefore within the housing (140). According to an aspect, the ring (136) and circumferential projection (138) of the initiator holder portion (128) may prevent axial displacement of the circular clip projection (186) from the slot (187) by frictionally engaging with a section of the interior wall (150) of the perforating gun housing (140) adjacent to the slot (187). The circular clip (183) also prevents the initiator holder portion (128) from moving axially by blocking movement of the ring (136) toward the housing first end (142). According to an aspect, the circular clip (183) is formed from a stamped, laser cut, or water-jet cut sheet of metal. The circular clip (183) may be formed from at least one of stainless steel, brass, copper, aluminum or any other electrically conductive sheeted material which can be stamped and re-worked, water jet cut or laser cut.

With reference to FIGS. 10-11, a rotating shaped charge positioning device (100/203) according to an embodiment is positioned in the housing chamber (145) of the perforating gun housing body (140) such that a rotational path of each of the shaped charge (155) and counterweight (156) aligns with a continuous recessed band (154) formed on the external surface (152) of the gun housing (140), meaning a portion of the perforating gun housing wall (141) having a smaller wall thickness than the surrounding gun housing wall to minimize the force needed for the shaped charge (155) to fire through the housing wall (141). According to an aspect, the shaped charge (155) is configured to rotate 360 degrees about the central longitudinal axis of rotation X of the rotating shaped charge positioning device (100/203). The shaped charge (155) is retained in the shaped charge receptacle (108) in a position external of the channel (106), and oriented such that an opening (157) of the shaped charge faces the housing wall (141) to fire radially outwardly through the housing wall (141) in a direction opposite to or away from the shaped charge holder portion (101/204) and the rotating shaped charge positioning device (100/203). The retention mechanism (112) engages a contoured surface portion of the shaped charge (155) to secure the shaped charge (155) in the shaped charge receptacle (108). In the exemplary embodiment, for example, the hook (114) is positioned in a depression (158) formed on the shaped charge wall (160) and coupled with a lip (159) formed below the depression (158). A lower conical portion (161) of the shaped charge is positioned in the shaped charge receptacle recess (109) such that a base (162) of the shaped charge is aligned with the recess opening (110).

Similar to the shaped charge (155), the counterweight (156) may include surface features, such as the base, lower conical portion, depression, and lip, for engagement with the counterweight receptacle (115). Thus, for purposes of convenience, and not limitation, the features and characteristics of the counterweight (156) are not repeated here. It is contemplated that a second shaped charge (not shown) may be positioned in the counterweight receptacle (115) in place of the counterweight (156), for applications in which firing bidirectionally in a single plane is desired.

An initiator (163) (FIG. 11) positioned in the initiator holder cavity (133) of the initiator holder portion (128) may be an initiator including an initiator head (164) positioned adjacent the initiator holder first end (129) and an initiator body (165) extending from the initiator head (164) through the initiator holder cavity (133) into the channel (106) via the shaped charge holder first opening (103) and first rotation coupling/first bearing configuration (124). According to an aspect, the initiator body (165) terminates adjacent to the opening (110) of the shaped charge receptacle (108) such that a tip (167) of the initiator body (165) and a portion of the body adjacent to the initiator tip (167) is positioned between the shaped charge base (162) and a base portion of the counterweight (130). In the exemplary embodiment, a diameter of the channel (106) along the tapered midsection (116) is substantially equal to the diameter of the initiator body (165), such that a portion of the channel wall (107) defining the tapered midsection (116) contacts the initiator body (165) to minimize axial movement of the initiator (163) once the initiator is positioned within the channel (106). The initiator (163) is configured to initiate the shaped charge (155) in response to an initiation signal, such as a digital code.

According to an aspect, the initiator (163) is a wireless push-in detonator. Such detonators are described in U.S. Pat. Nos. 9,605,937 and 9,581,422, both commonly owned and assigned to DynaEnergetics Europe, each of which is incorporated herein by reference in its entirety. According to an aspect and with continued reference to FIG. 8, the initiator head (164) includes an electrically contactable line-in portion, an electrically contactable line-out portion, and an insulator positioned between the line-in and line-out portions, wherein the insulator electrically isolates the line-in portion from the line-out portion. The initiator body (165) may be energetically coupled to or may energetically communicate with the shaped charge (155). In an embodiment, the initiator (163) is formed of a unitary piece of aluminum. According to an aspect, an initiator shell (166) encasing the initiator body (165) may include a metal surface, which provides a contact area for electrically grounding the initiator (163). According to an aspect, the initiator shell (166) may include an insulating layer that at least partially encloses the initiator (163). The insulating layer prevents the initiator shell (166) from being in contact with the material forming the casing of the shaped charge (155) and the material forming the perforating gun housing (140). The insulating layer of the initiator shell (166) may include a non-conductive material. According to an aspect, the insulating layer is composed of at least one of an electrically non-conductive injection molded plastic, a machined non-conductive material, and surface anodized aluminum. The initiator shell (166) may be coated with the insulating layer so that the initiator body (165) is not conductive, and only the tip (167) of the initiator (163) is conductive for electrical contact with a downstream electrical component, e.g., the first electrically contactable bulkhead component (171).

Figure 12:
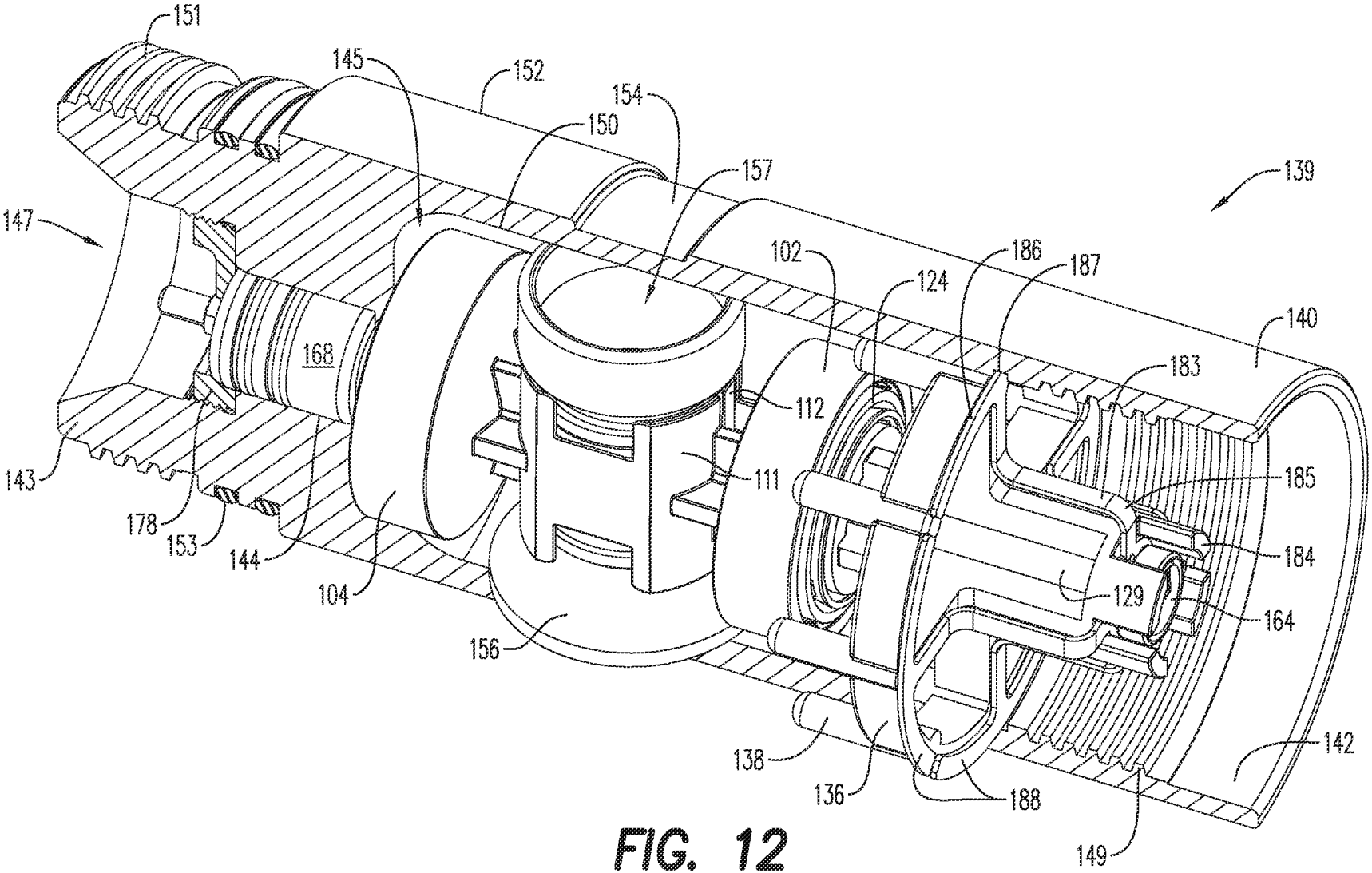
FIGS. 12-14 are perspective, partial cross-sectional views of a perforating gun assembly according to the embodiment shown in FIG. 10, illustrating a rotating shaped charge positioning device according to the embodiment shown in FIG. 10, in a first position, a second position, and a third position, according to an aspect.

FIGS. 12-14 illustrate views of a rotating shaped charge positioning device (100) positioned within a perforating gun housing body (140), in three rotational positions. Depending on the size and weight of the shaped charge (155), a center of gravity of the shaped charge (155) secured within the shaped charge holder portion (101) may be offset from the central longitudinal axis of rotation X of the shaped charge holder portion (101) and/or the rotating shaped charge positioning device (100). The gravitational orientation of the shaped charge (155) is influenced by factors including addition of the counterweight (156) to the shaped charge holder portion (101), relative weight/mass of the shaped charge (155) and the counterweight (156), and relative positioning of the shaped charge receptacle (108) and the counterweight receptacle (115) on the external surface of the channel wall (107) of the shaped charge holder portion (101). According to an aspect and with reference to FIG. 12, the counterweight (156) may have a center of gravity offset from the rotational axis X of the shaped charge holder portion (101). When the rotating shaped charge positioning device (100) is assembled and positioned in the perforating gun housing body (140), the shaped charge holder portion (101) may rotate to position the counterweight (156) below the rotational axis X to gravitationally orient the open end (157) of the shaped charge (155) in a directly upward firing direction. According to an aspect, the weight/mass of each of the shaped charge (155) and counterweight (156) may be distributed in a manner that results in the gravitational orientation of the shaped charge (155) being offset from a directly vertical orientation. FIG. 13, for example, illustrates the rotating shaped charge positioning device (100) of FIG. 12 wherein the shaped charge (155) and counterweight (156) are offset from a directly vertical arrangement. According to a further aspect and as shown in FIG. 11, the rotating shaped charge positioning device (100) may be loaded into the housing chamber (145) with no counterweight (156), ensuring that the weight/mass of the shaped charge (155) will influence rotation of the shaped charge holder portion (101) to gravitationally orient the shaped charge opening (157) directly downward. In an embodiment, the shaped charge positioning device (203) of FIGS. 7-9 including the pocket (207) and weight (208) may be loaded into the gun housing (145) with one shaped charge positioned in the shaped charge receptacle (108). According to an aspect, the weight/mass of the shaped charge (155) is larger than the weight/mass of the pocket (207) and weight (208) in combination, meaning that rotation of the shaped charge holder portion (101) is influenced by the weight/mass of the shaped charge (155) to gravitationally orient the shaped charge opening (157) directly downward.

Figure 15:
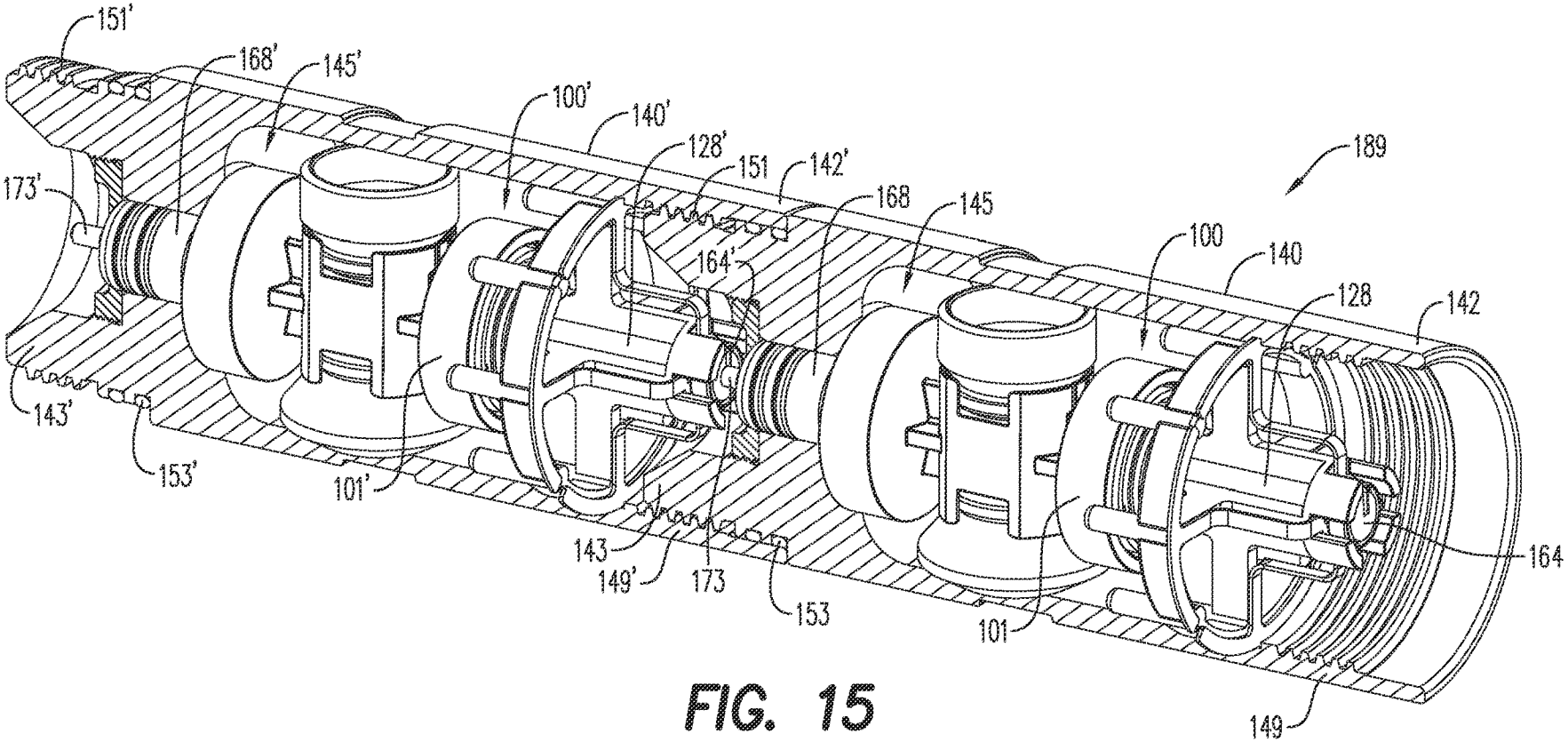
FIG. 15 is a perspective, partial cross-sectional view of a perforating gun string including a rotating shaped charge positioning device, according to an embodiment.
Figure 16:
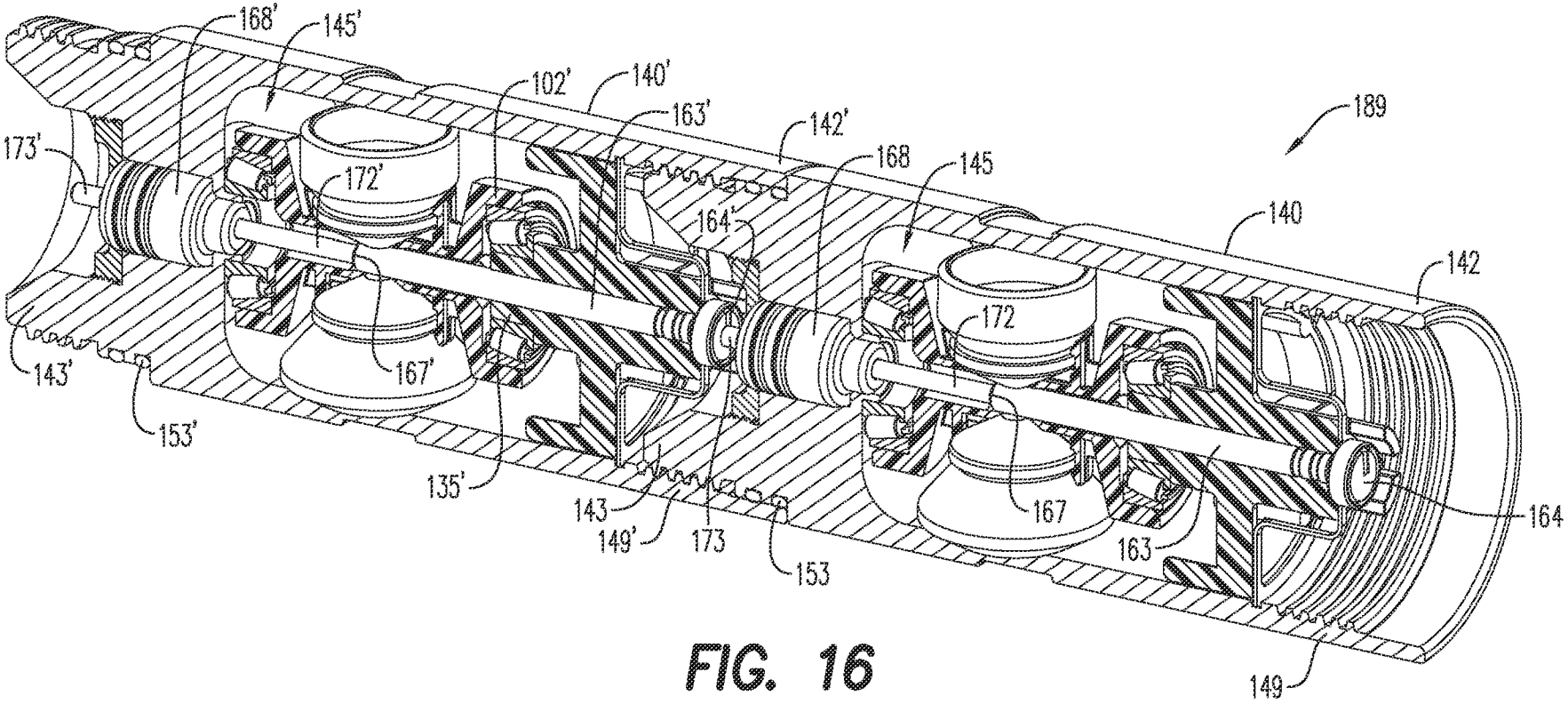
FIG. 16 is a perspective, full cross-sectional view of a perforating gun string according to the embodiment shown in FIG. 15.
Figure 17:
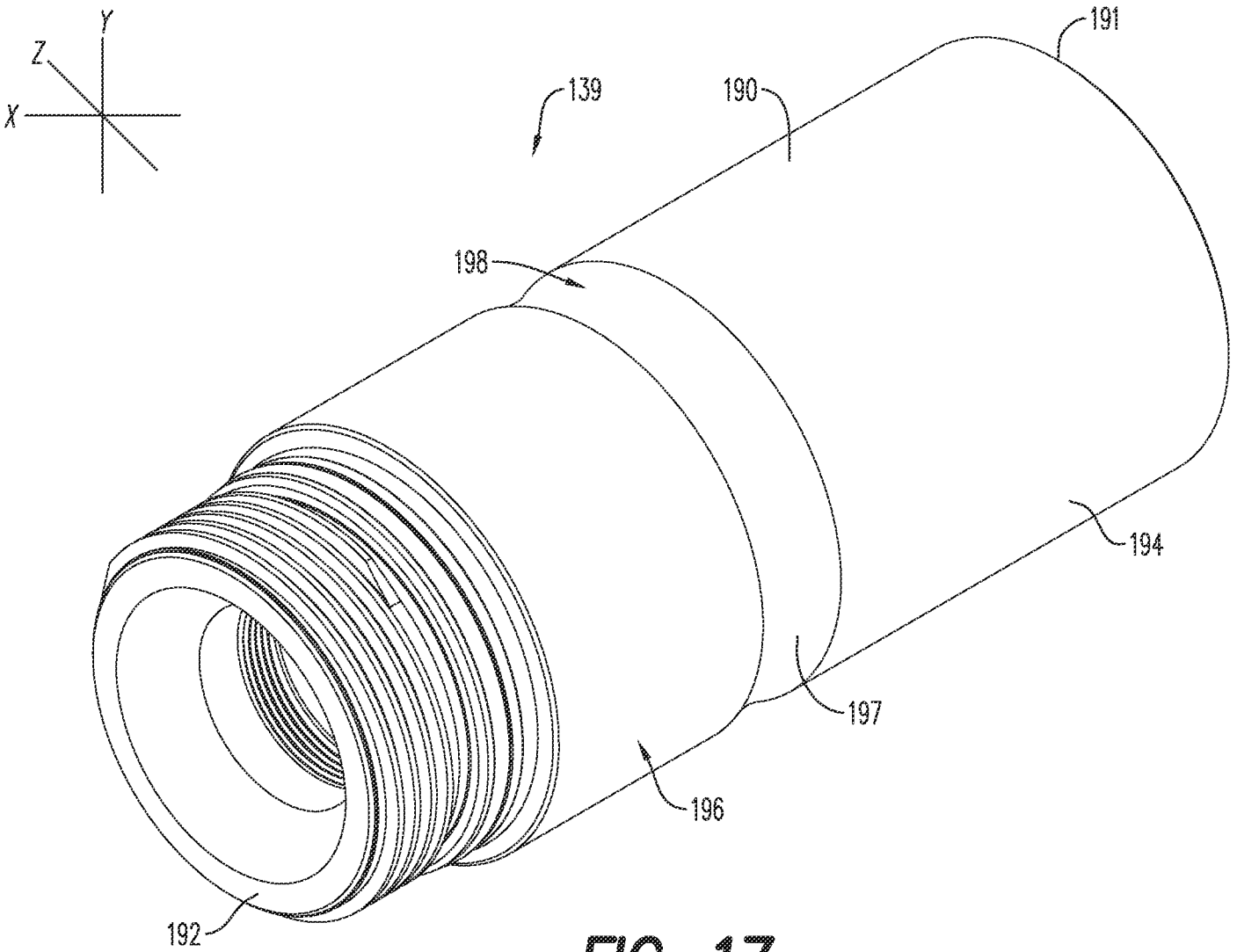
FIG. 17 is a perspective view of a perforating gun housing according to an embodiment.

According to an aspect, the gun housing body (140) includes threaded surface portions at each of the first housing end (142) and the second housing end (143) to facilitate the coupling of adjacent perforating gun assemblies (139) together in an end-to-end configuration. According to an aspect and as shown in FIG. 10, for example, an inner surface (150) of the housing wall (141) includes a threaded inner surface (149) at the first housing end (142), and an external surface (152) of the housing wall (141) includes a threaded outer surface (151) at the second housing end (143). With reference to FIGS. 15-16, the first perforating gun housing (140) may be coupled in an end-to-end engagement with an adjacent or second perforating gun housing (140') to form a perforating gun string (189), such that a portion of the first perforating gun housing (140) axially overlaps with a portion of the second perforating gun housing (140'). The second housing end (143) of the first gun housing (140) may be positioned and threadingly secured within the first housing end (142') of the adjacent perforating gun housing (140'). A sealing mechanism, such as o-ring (153), may be used to seal the adjacent perforating gun housing (140') from the first perforating gun housing (140) and/or from the external wellbore environment. In the exemplary embodiment of FIG. 16, the bulkhead assembly (168) of the first perforating gun housing (140) is in electrical communication with each of the initiators of the first perforating gun assembly (e.g., initiator 163) and the adjacent perforating gun assembly (e.g., initiator 163') via contact between the first electrically contactable bulkhead component (172) of the bulkhead assembly (168) with the electrically contactable tip (167) of the first initiator (163), and between the second electrically contactable bulkhead component (172) with the initiator head (164') of the adjacent initiator (163').

Embodiments of the disclosure are further associated with a perforating gun assembly (139) for providing a firing path for a rotating shaped charge (155). With reference to FIGS. 17-20, the perforating gun assembly (139) includes a gun housing body (190) having a housing first end (191) and a housing second end (192) spaced apart from the housing first end (191). A chamber (193) extends from the housing first end (191) toward the housing second end (192) that is defined by a housing wall (194) having an inner surface (195) and an outer surface (196). A rotating shaped charge holder (101) is positioned within the chamber (193). The rotating charge holder (101/204) may be configured substantially as described hereinabove and illustrated in FIGS. 1-16. In an embodiment, the rotating charge holder (101/204) may include a gravity positioning device ("GPS"), discussed further below with reference to FIGS. 18-21.

A banded scallop (197) is formed on the outer surface (196) of the housing wall (194) axially overlapping with the shaped charge receptacle (108). When the rotating charge holder (101) is positioned in the chamber (193) of the perforating gun housing body (190), an opening (157) of the shaped charge (155) secured therein may be directed in any angle along the radial Y-planar firing path as defined by the continuous banded scallop (197). In the exemplary embodiment, a cross section of the banded scallop (197) along a plane including the central longitudinal axis X includes a curved surface. According to an aspect, the banded scallop (197) may be defined by an arc-shaped recess (198) formed on the external surface (196) of the housing wall (194), such that the firing path of the shaped charge (155) corresponds to a portion of the housing wall (194) that has a reduced thickness area extending around the circumference of the wall (194). The reduced thickness area of the banded scallop (197) reduces the force needed for the shaped charge (155) to fire through the housing wall (194). According to an aspect, the banded scallop (197) may be formed or created through the use of a lathe/turning tooling machine. The same lathe/turning tool machine may be used to form the internal threads (149) and the external threads (151) of the housing (discussed above with reference to FIGS. 10-11).

Figure 18:
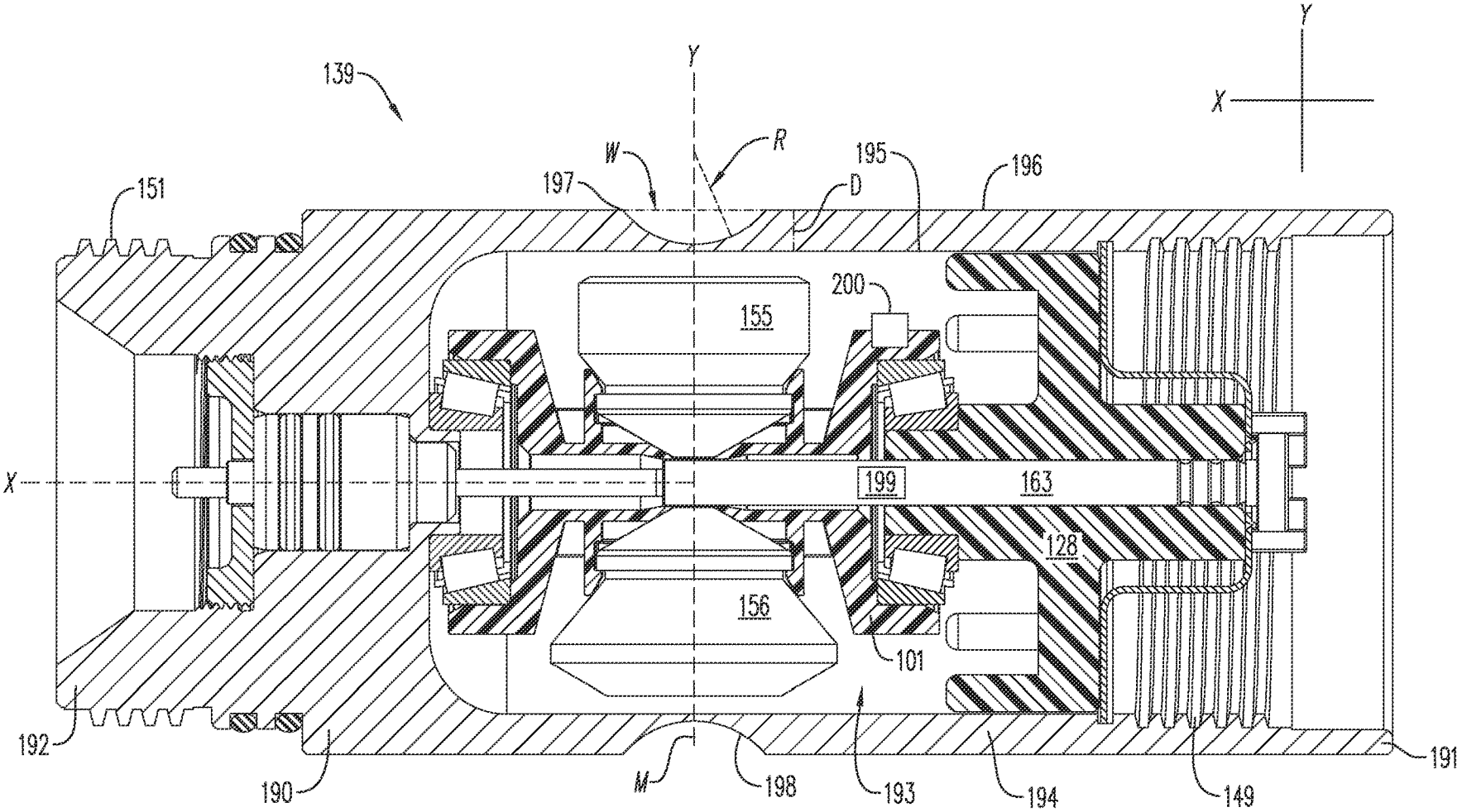
FIG. 18 is a side, cross-sectional view of a perforating gun housing according to the embodiment shown in FIG. 17, illustrating a rotating shaped charge positioning device according to an embodiment.

In an embodiment, and with reference to FIG. 18, the continuous banded scallop (197) may be defined by arc-shaped recess (198) having an arc radius of a dimension as required by the application to provide a sufficiently wide firing path for the shaped charge (155) while ensuring the structural integrity of the perforating gun assembly (139) when positioned in the wellbore before firing and to prevent collapse of the gun housing body (190) after firing. For purposes of this disclosure, arc radius is the radius of an arc or segment, that is equal to the radius of the circle of which it is a part. With reference to FIG. 18, R is the radius of a circle formed in part by the arc-shaped recess (198) having the stated dimensions. The dimensions of the arc-shaped recess (198), including the depth/height D and width W, will correspond with the radius R of the circle forming the arc-shaped recess (198). For example, the banded scallop (197) may be formed with a depth/height D of about 0.05 inches to about 0.10 inches, a width W of about 0.80 inches to about 0.90 inches, and an arc radius R of about 0.90 inches to about 1.30 inches. According to an aspect, the depth D of the arc-shaped recess (198) may vary across its width W. In an embodiment, the greatest depth D of the banded scallop (197) is at a midpoint M of the arc-shaped recess (198).

Embodiments of this disclosure are further associated with a rotating charge holder (101/204) equipped with a position measuring device (200) to mechanically or electrically sense the actual rotational position of the shaped charge (155), or the vertical orientation of the shaped charge (155), relative to gravity and/or the central longitudinal axis of rotation X of the rotating shaped charge holder (101/204). The rotating charge holder (101/204) may be configured substantially as described hereinabove and illustrated in FIGS. 1-9. Thus, for purposes of convenience, and not limitation, the features and functionality of the positioning device (101/204) are not repeated in detail hereinbelow.

Figure 19:
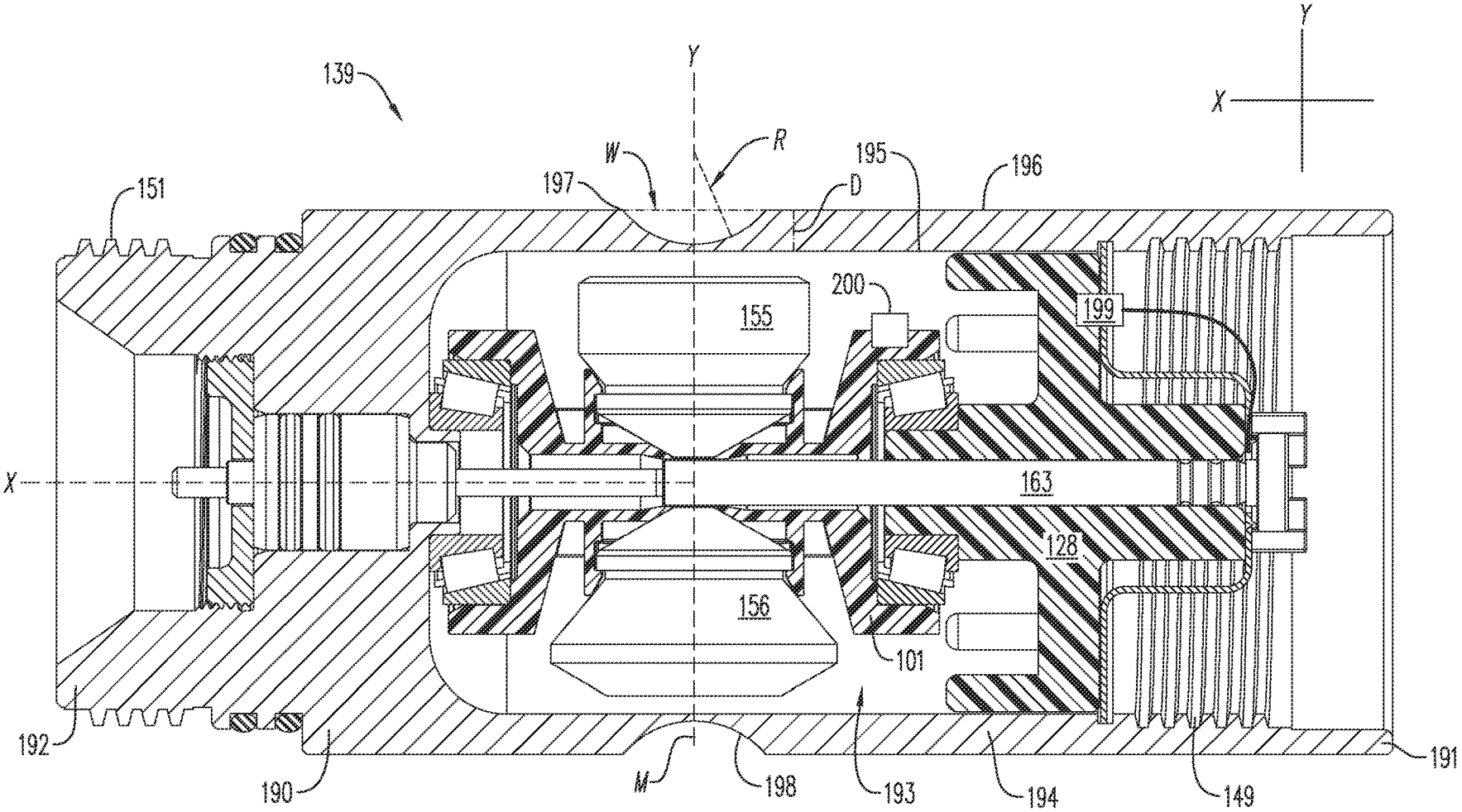
FIG. 19 is a side, cross-sectional view of a perforating gun housing according to the embodiment shown in FIG. 17, illustrating a rotating shaped charge positioning device according to an embodiment.
Figure 20:
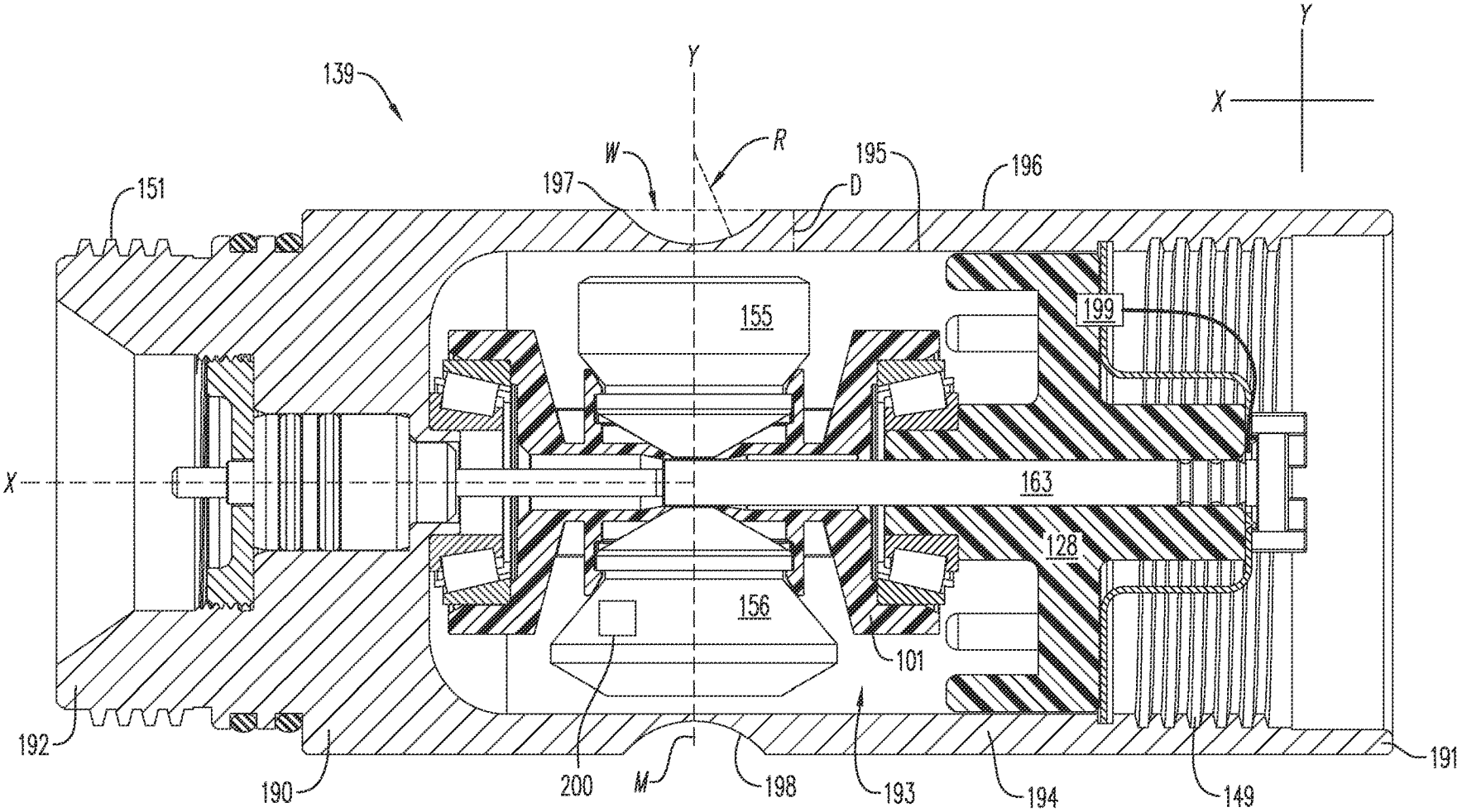
FIG. 20 is a side, cross-sectional view of a perforating gun housing according to the embodiment shown in FIG. 17, illustrating a rotating shaped charge positioning device according to an embodiment.

According to an aspect, the measuring device (200) may be used to determine whether the opening (157) of the shaped charge (155) is vertically oriented for firing at a desired orientation, such as 0-degree or 180-degree orientation. In embodiments shown in FIGS. 18-21, the rotating shaped charge holder (101) is joined to the initiator holder (128), as discussed in detail with reference to FIGS. 5-6, and an initiator (163) is positioned within the initiator holder (128) along the central longitudinal axis of rotation X of the rotating shaped charge positioning device (100). According to an aspect, the rotating shaped charge positioning device (100) includes a measuring device (200) provided on a surface of the rotating shaped charge holder (101), the shaped charge (155), and/or the counterweight (156), and in communication with an electronics board or circuit board (199) that is electrically coupled to the initiator (163), for sending a signal relating to the rotational position of the shaped charge (155) and/or the shaped charge receptacle (108) from the measuring device (200) to the initiator (163). According to an aspect, the measuring device (200) is an inclinometer that is a surface mounted device (SMD) provided on a surface of the shaped charge positioning device (100) that is rotatable relative to the gun housing (140), such as the shaped charge holder first end (102)(FIGS. 18 and 19) or the counterweight (156) (FIG. 20). According to an aspect, the measuring device (200) is axially aligned with the initiator holder cavity (133) and/or a portion of the initiator (163) such that a surface of the measuring device (200) is aligned in parallel with the cavity (133) and the longitudinal axis of rotation X of the shaped charge positioning device (100).

In an exemplary embodiment, and as shown in FIG. 18, the circuit board (199) may be provided integrally with the initiator (163) as an internal component of the of the initiator (163). For example, the circuit board (199) may be provided in the initiator body (165) or in the initiator head (164). In an embodiment, the circuit board (199) may be provided in a position inside the perforating gun housing (140) separate from the initiator (163) and in electrical communication with an electronics board or circuit board provided in the initiator (163). With reference to FIGS. 19 and 20, the circuit board (199) may be positioned on the initiator holder (128) and electrically coupled to the initiator (163) via a signal wire (201). According to an aspect, the circuit board (199) may include a position sensor configured to provide a reference point that is detectable by the measuring device (200), such as a 0 degree reference point.

According to an aspect, the measuring device (200) detects a rotational position of the shaped charge (155) around the central longitudinal axis of rotation X of the shaped charge positioning device (100) to determine, for example, the firing direction of the opening (157) of the shaped charge (155). According to an aspect, the initiator (163) is configured to initiate the shaped charge (155) in response to a signal from the measuring device (200) satisfying a predetermined condition relating to the rotational position of the shaped charge (155). According to an aspect, the measuring device (200) may be a single sensor (including, without limitation, sensors such as a inclinometer, a gyroscope, or an accelerometer) positioned on the rotating shaped charge positioning device (100) or incorporated into the initiator (163) or initiator circuit board (199) and configured to detect the position of the shaped charge (155) and communicate a signal to the initiator circuit board.

According to an aspect, the measuring device (200) sends a signal to the circuit board of the initiator (163) based on a rotational position of the shaped charge (155). For example, the measuring device (200) may send a signal to the circuit board (199) of the initiator (163) in response to the orientation of the shaped charge (155) meeting a predetermined threshold. In an embodiment, the measuring device (200) may send a positive indication signal to the circuit board (199) of the initiator (163) when the orientation is within a preprogrammed or predetermined range of rotational positions. For example, the predetermined range of rotational positions may be a range of rotation, for example, about 20-degree range of rotation, or between 15 and 25 rotational degrees from a predetermined reference point, such as a vertical or 0-degree reference point. In response to the positive indication signal, the initiator (163) initiates to fire the shaped charge (155) at the desired rotational position. According to an aspect, the measuring device (200) may send a negative indication signal to the initiator (163) when the orientation of the shaped charge (155) is outside of the predetermined range of rotational positions. In response to the negative indication signal, initiation of the initiator (163) is blocked to prevent firing of the shaped charge (155) at an undesired orientation. In another exemplary embodiment, instead of the positive indication signal and/or the negative indication signal, the measuring device (200) may send an encoded signal encoded with a rotational position of the shaped charge (155) and/or the shaped charge receptacle (108). The initiator (163) may be configured to initiate the shaped charge in response to the encoded signal satisfying a predetermined threshold.

In an embodiment, and with reference to FIGS. 19 and 20, the initiator (163) and the circuit board (199) are electrically connected via a signal wire (201). According to an aspect, the signal wire (201) provides a relay between the initiator (163) and the circuit board (199) for communication of the indication signal for firing the initiator (163) or blocking the initiation of the initiator (163). In the embodiment of FIGS. 19-20, the signal wire (201) may function as a through-wire to provide an electrical connection for electrical communication between adjacent perforating gun housings (190, 190'). For example, the signal wire (201) may provide an electrical connection with an adjacent initiator (163') to provide a relay between the initiator (163), the circuit board (199), and the adjacent initiator (163'). According to an aspect, the circuit board (199) may include a position sensor for communicating with the measuring device (200), for example, to indicate a reference angle for measurement via the measuring device (200).

Figure 21:
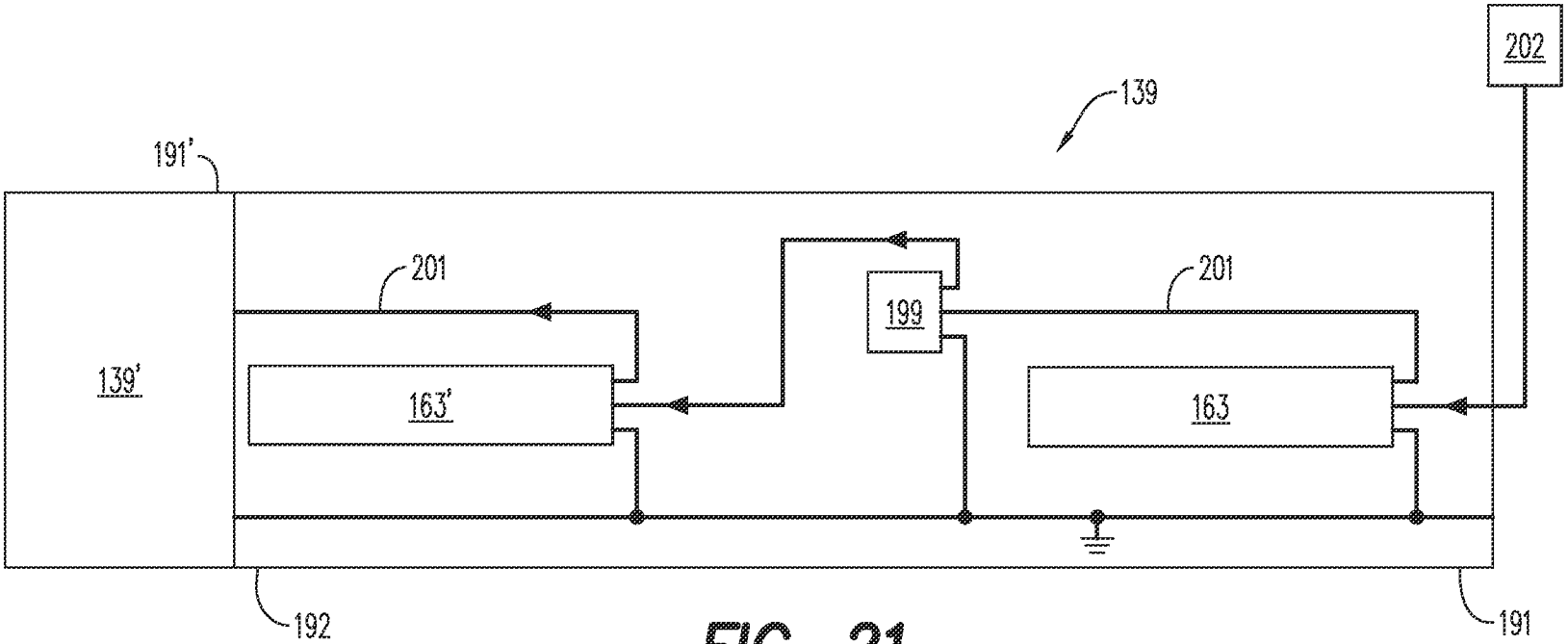
FIG. 21 is a schematic diagram of a perforating gun string according to an embodiment.

According to an aspect and with reference to FIG. 21, the signal wire (201) may additionally or alternatively provide electrical communication between a gun assembly (139) and a surface communication unit (202) to provide signal relay between the initiator (163), the measuring device (200), and the surface communication unit (202). According to an aspect, sensor information regarding the orientation of the shaped charge (155) and/or information regarding the positive indication signal and negative indication signal sent from the measuring device (200) to the initiator (163) can be communicated to the surface communication unit (202) via the signal wire (201). According to an aspect, the surface communication unit (202) may include an indicator light for emitting a light signal associated with each of the position indication signal and the negative indication signal.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A shaped charge positioning device, comprising:

a shaped charge holder;

an initiator holder coupled to the shaped charge holder via a first rotation coupling;

a shaped charge receptacle provided on the shaped charge holder, wherein the shaped charge receptacle is rotatable around a central longitudinal axis of rotation of the shaped charge positioning device relative to the initiator holder;

an initiator provided in the initiator holder; and a measuring device in electrical communication with the initiator, wherein the measuring device is configured to detect a rotational position around the central longitudinal axis of rotation and transmit a signal based on the rotational position.

2. The shaped charge positioning device of claim 1, further comprising:

a shaped charge provided in the shaped charge receptacle, wherein a combined center of gravity of the shaped charge holder and the shaped charge is displaced from the central longitudinal axis of rotation of the shaped charge positioning device.

3. The shaped charge positioning device of claim 1, further comprising:

a channel formed through the shaped charge holder; and an initiator holder cavity formed through the initiator holder, wherein the channel and the initiator holder cavity are in communication through the first rotation coupling.

4. The shaped charge positioning device of claim 3, wherein:

the shaped charge receptacle is provided on the shaped charge holder radially outward from the channel with respect to the central longitudinal axis.

5. The shaped charge positioning device of claim 3, wherein the initiator is provided in the initiator holder cavity and the measuring device is configured to transmit the signal to the initiator; and wherein the measuring device is configured to detect the rotational position, wherein the rotational position is the position of the shaped charge receptacle around the central longitudinal axis of rotation, and transmit the signal based on the rotational position of the shaped charge receptacle.

6. The shaped charge positioning device of claim 5, wherein:

the initiator extends into the channel through the first rotation coupling.

7. The shaped charge positioning device of claim 1, further comprising:

a second rotation coupling spaced apart from the first rotation coupling along the central longitudinal axis of rotation of the shaped charge positioning device.

8. The shaped charge positioning device of claim 1, further comprising:

a shaped charge provided in the shaped charge receptacle;

the initiator is provided in an initiator holder cavity formed through the initiator holder, wherein the initiator extends into a channel formed through the shaped charge holder via the first rotation coupling; and the measuring device is configured to transmit the signal to the initiator, and the initiator is configured to initiate the shaped charge in response to the signal from the measuring device satisfying a predetermined condition.

9. A perforating gun assembly, comprising:

a gun housing including an interior chamber;

a shaped charge holder provided in the interior chamber;

a shaped charge receptacle provided on the shaped charge holder;

an initiator holder provided in the interior chamber, wherein the initiator holder is fixed relative to the gun housing, and wherein the shaped charge holder is rotatably coupled to the initiator holder via a rotation coupling;

an initiator provided within the interior chamber, wherein the initiator is configured for receiving an initiation signal and initiating in response to the initiation signal, and the initiation signal is based on satisfying a predetermined condition; and a bulkhead assembly positioned at an end of the gun housing, wherein the shaped charge holder is rotatable relative to the gun housing and the bulkhead assembly is electrically coupled to the initiator.

10. The perforating gun assembly of claim 1, wherein the initiator is received within an initiator holder cavity formed through the initiator holder.

11. A wellbore tool string, comprising:

a first gun housing including a first interior housing chamber;

a second gun housing including a second interior housing chamber;

a first shaped charge holder provided in the first interior housing chamber, wherein the first shaped charge holder is rotatable relative to the first gun housing;

a first initiator holder provided in the first interior housing chamber, wherein the first initiator holder is fixed relative to the first gun housing;

a first initiator provided in the first interior housing chamber, wherein the first initiator is provided in the first initiator holder; and a first bulkhead assembly positioned at a first housing end of the first gun housing, wherein the first bulkhead assembly is configured for transmitting an electrical signal to the first initiator, wherein the first initiator is configured for receiving an initiation signal and initiating in response to the initiation signal, and the initiation signal is based on satisfying a predetermined condition; and a second shaped charge holder provided in the second interior housing chamber;

a second initiator holder provided in the second interior housing chamber, wherein the second initiator holder is fixed relative to the second gun housing;

a second initiator provided in the second interior housing chamber, wherein the second initiator is provided in the second initiator holder; and a second bulkhead assembly positioned at a first housing end of the second gun housing, wherein the second bulkhead assembly is configured for transmitting the electrical signal to the second initiator, the second shaped charge holder is rotatable relative to the second gun housing, and the first perforating gun housing and the second gun housing are coupled together.

12. The wellbore tool string of claim 11, wherein the first initiator is electrically coupled to the second initiator via the second bulkhead assembly.

* * * * *